US007600273B2

(12) United States Patent
Gruenwald et al.

(10) Patent No.: US 7,600,273 B2
(45) Date of Patent: Oct. 13, 2009

(54) SPA APPARATUS

(75) Inventors: David J. Gruenwald, Butte des Morts, WI (US); Edwin B. Hatch, West Bend, WI (US); David A. Schmitz, Reeseville, WI (US); Jeremy M. Lenzendorf, West Bend, WI (US); John A. Groeschel, Theresa, WI (US)

(73) Assignee: European Touch Holdings, Inc., Milwaukee, WI (US)

( * ) Notice: Subject to any disclaimer, the term of this patent is extended or adjusted under 35 U.S.C. 154(b) by 796 days.

(21) Appl. No.: 10/744,241

(22) Filed: Dec. 23, 2003

(65) Prior Publication Data

US 2004/0177438 A1 Sep. 16, 2004

Related U.S. Application Data

(63) Continuation-in-part of application No. 10/385,916, filed on Mar. 11, 2003, now Pat. No. 6,880,182.

(60) Provisional application No. 60/510,969, filed on Oct. 14, 2003, provisional application No. 60/436,128, filed on Dec. 23, 2002.

(51) Int. Cl.
*A47K 3/00* (2006.01)

(52) U.S. Cl. ..... 4/541.1

(58) Field of Classification Search ..... 4/541.1, 4/540, 560.1, 574.1, 578.1, 590, 621, 622; 601/156–160; 297/182, 188.01, 188.09, 297/243.21, 310; 5/600, 606, 613, 618
See application file for complete search history.

(56) References Cited

U.S. PATENT DOCUMENTS 555,860 A * 3/1896 Hanger ..... 4/517
2,061,142 A 11/1936 Denocenzo
2,312,524 A 3/1943 Cox
2,417,499 A 3/1947 Ille
2,733,711 A 2/1956 Gibson
2,738,787 A 3/1956 Jacuzzi et al.
3,159,849 A 12/1964 Jacuzzi
3,273,560 A 9/1966 Jacuzzi
3,287,741 A 11/1966 Nash
3,297,025 A 1/1967 Jacuzzi
3,760,800 A * 9/1973 Staffin et al. ..... 601/17

(Continued)

FOREIGN PATENT DOCUMENTS

JP 6-46964 2/1994

(Continued)

*Primary Examiner*—Huyen Le
(74) *Attorney, Agent, or Firm*—Foley & Lardner LLP

(57) ABSTRACT

A spa apparatus includes a chair and a basin supported by a base. The basin is movable in an up/down direction relative to a portion of the base. The chair may include actuators to tilt forward to permit easy entry and exit from the chain. The chair may also move in a fore/aft direction relative to the basin. A pair of foot rests may be located within the basin. A manicure assembly may be located within a cavity in the arm of the chair. The basin may have a narrowed front portion to allow a technician to easily fact the customer. A base may include two support frames that pivot relative to one another proximate an end of the base distal the basin.

21 Claims, 26 Drawing Sheets

U.S. PATENT DOCUMENTS 3,832,740 A * 9/1974 McClarrin ..... 4/611
3,924,278 A * 12/1975 Ekman ..... 4/540
3,940,807 A 3/1976 Baker et al.
3,964,471 A 6/1976 Saethre
3,965,495 A 6/1976 McNair
4,004,302 A 1/1977 Hori
4,115,878 A 9/1978 Johnson et al.
4,168,705 A 9/1979 Raab
4,181,124 A * 1/1980 Pauletich ..... 601/157
4,184,488 A 1/1980 Bielich
4,330,412 A 5/1982 Frederick
4,349,434 A 9/1982 Jaworski
4,372,605 A * 2/1983 Cervantes ..... 297/188.11
4,420,846 A 12/1983 Bonner
4,485,503 A 12/1984 Rolando et al.
4,520,525 A 6/1985 Yogi et al.
4,525,881 A 7/1985 Higginbotham
4,665,572 A 5/1987 Davidson et al.
4,742,584 A 5/1988 Abe
4,853,987 A 8/1989 Jaworski
4,885,810 A * 12/1989 Unger et al. ..... 4/496
4,903,352 A 2/1990 Murakami
4,974,268 A * 12/1990 Cors et al. ..... 4/590
4,984,583 A 1/1991 Peterson et al.
4,993,777 A * 2/1991 LaPointe ..... 297/325
5,044,357 A 9/1991 Johns
5,083,329 A 1/1992 Murakami
5,588,161 A 12/1996 Barradas
5,729,841 A 3/1998 Chan
6,003,166 A 12/1999 Hald et al.
D429,379 S 8/2000 Kim
D429,380 S * 8/2000 Fontier et al. ..... D28/56
6,094,756 A * 8/2000 Carter ..... 4/578.1
D434,916 S 12/2000 Galati, Jr. et al.
D435,937 S 1/2001 Back et al.
6,357,059 B1 3/2002 Lau
D455,017 S 4/2002 Tran
D455,566 S 4/2002 Park
D456,154 S 4/2002 Huynh et al.
6,363,548 B1 4/2002 Kuo
6,393,633 B2 5/2002 Ferber
6,438,768 B1 8/2002 Yen
6,503,212 B2 * 1/2003 Park ..... 601/158
6,598,244 B1 7/2003 Yeh
D479,919 S * 9/2003 Genelli et al. ..... D6/336
6,732,387 B1 * 5/2004 Waldron ..... 4/622
6,739,003 B1 * 5/2004 Fanuzzi ..... 5/606

FOREIGN PATENT DOCUMENTS

JP 6-78858 3/1994
JP 6-339509 12/1994

* cited by examiner

SPA APPARATUS

CROSS-REFERENCE TO RELATED PATENT APPLICATIONS

This application claims the benefit under 35 USC 119(e) U.S. application Ser. No. 60/436,128, filed Dec. 23, 2002, incorporated herein by reference in its entirety and claims the benefit under 35 USC 119(e) U.S. application Ser. No. 60/510,969, filed Oct. 14, 2003, incorporated herein by reference in its entirety. This application is a Continuation-in-part of U.S. application Ser. No. 10/385,916, filed Mar. 11, 2003, incorporated herein by reference in its entirety which claims the benefit under 35 USC 119(e) U.S. application Ser. No. 60/436,128, filed Dec. 23, 2002.

FIELD OF THE INVENTION

The present invention relates to a spa device. In particular, the present invention relates to a spa apparatus for use in activities related to a foot massage.

BACKGROUND OF THE INVENTION

It is generally known to provide for a spa device, such as health spas, whirlpools, jet stream exercisers, foot spas, etc. Such known spa devices are typically used in commercial and recreational settings for hydrotherapy, massage, stimulation, pedicure, and bathing purposes. However, such spa devices have several disadvantages including being difficult to thoroughly clean, requiring complicated maintenance schedules, and often providing harsh and uncomfortable massages.

Water quality can become a problem in systems that use circulating water that comes into contact with the human body where the spa is not thoroughly cleaned. Several actions have been taken in an attempt to overcome this difficulty, including the addition of chemicals (e.g., bleach) into the water to help control bacteria growth. Despite such efforts, however, water quality is sometimes still difficult to maintain. For example, bacteria can develop simple defense mechanisms to counter chemical attacks such as forming a protective outer coating that acts as a barrier against harsh chemical treatments. The destruction of the outer coating is generally difficult with chemicals alone. Often times, chemicals are only effective in destroying the outer coating when used for extended periods of time, sometimes hours. Therefore, the preferred method of eliminating bacteria from systems is through mechanical means such as abrasion (e.g., removal with a rag and a chemical cleanser that has anti-bacterial capabilities).

Furthermore, many spa devices have intricate and elaborate systems of pipes that move water from a pump, through a filtering system, and ultimately to one or more nozzles (e.g., openings) that deliver water back to a basin for re-circulation. In the case of a pedicure basin, the process of cleaning after each pedicure involves draining the water from the system, spraying the basin with some type of anti-bacterial cleanser, circulating the water for a period of time, rinsing and then refilling with fresh water. Because there are pipes and fittings, it is often difficult to mechanically scrub every component that comes into contact with water. In addition, after a system is drained, some water may remain within the piping system, usually in cracks and crevices or low spots in the pumping system. For example, the pump itself is usually a sealed unit that may be difficult to completely drain. It is within these areas that the bacteria tend to grow the outer coating as a defensive mechanism against attack from anti-bacterial chemicals, especially when the pedicure system is not used for extended periods (e.g., overnight, weekends, etc.). Consequently, water quality may be diminished in conventional piped systems that are not effectively cleaned.

Another problem with known spa devices is that they often provide a harsh massaging effect to the feet by pointing a small number of nozzles (e.g., openings) toward the top of the feet. These nozzles are generally connected via pipes and hoses to a single centrifugal pump that produces a very high pressure (20-40 psi) and a relatively low volume of water. Customers often complain that the jets of water produced in this manner are too rough, in some cases even producing pain or discomfort. Although the jets can be partially closed to reduce the force of the water stream, this also reduces the water volume. Consequently, the massage effect is minimized since the jets are often a considerable distance away from the feet (e.g., in the walls of the basin).

An example of an existing system is disclosed in U.S. Pat. No. 2,312,524 issued to William B. Cox. Specifically, Cox discloses a foot bathing device that utilizes foot rests consisting of a disk of heavy wire screening or a perforated plate (see col. 1, lines 43-44). This type of system can have several disadvantages including producing unrestricted streams of water. For example, Cox discloses the use of a flat foot rest containing a uniform pattern of openings across the entire foot rest that is not capable of directing the water in any particular direction (e.g., a foot rest that includes a uniform grid pattern across the entire foot rest).

Accordingly, it would be advantageous to provide a spa apparatus that substantially avoids the problems of bacterial growth by eliminating the need for pipes and/or pumps. Further, it would be advantageous to provide a spa apparatus with a removable foot rest plate for easy access to clean the basin and exposed components. It would also be advantageous to provide a spa apparatus that produces an improved massage of the foot by directing a flow of water at a much lower pressure while still maintaining a higher volume of water to specific areas of the foot. In addition, it would be advantageous to provide a spa apparatus that substantially eliminates the water fountain effect (e.g., excess splashing) sometimes found in other pedicure systems.

Typically, the basin of a spa is positioned close to the floor to minimize the distance that a user must raise the user's feet in order to place them in the basin. This then requires the technician working on the user's feet to bend over in order to reach the user's feet. If the basin is located in a position higher from the ground to enable greater comfort for the technician, then the user must raise the user's feet a greater distance to clear the top of the basin. It would therefore be desirable to provide a basin that both allows easy entrance and exit of a user's feet as well as allow the basin to be raised to benefit the technician, as well as to provide an aesthetically and functional spa.

A typical spa includes a chair that is in a fixed position relative to the basin. This requires that the customer climb into the chair avoiding the basin, and further requires that the customer adjust herself in the chair to comfortably place her feet in the basin. For the elderly or frail it may be difficult to enter and exit the chair. Additionally, for those who are shorter or taller then the average user, the position of the chair may not be comfortable or conveniently positioned. It would therefore be desirable to provide a chair that permitted easy entry and exit into the chair. It would also be desirable to provide a chair that could be moved relative to the basin for the comfort of the customer.

When a technician works on a user's foot, the foot must be elevated out of the basin, the customer's foot is typically held by the technician on his or her lap or set upon a support that is a separate structure located outside of the basin, that either must be moved over the basin area, or the user must swing the user's foot out of the basin area onto the support. This position may not be comfortable for either the customer or the technician. It would be desirable to provide a support that is easy to use by the technician and customer that does not require a separate structure to be moved in and out of the basin area.

Typically the shape of a basin is substantially round. This shape makes it difficult for the technician to come close to the basin while facing the customer. The technician is forced to sit side ways with the technician's legs both offset to one side of the basin. It would be desireable to provide a basin having a shape that would allow a technician to easily straddle the basin with one leg on either side of the basin.

Additionally, typical pedicure spas require a separate manicure table to be moved toward or away from the chair in order for a technician to work on the customer's finger nails. It would be desireable to provide a manicure assembly system that could be easily stored within a portion of the chair and easily deployed when required.

It would further be desirable to provide for a spa apparatus having one or more of these or other advantageous features discussed above either alone or in any combination.

SUMMARY OF THE INVENTION

A feature of the present invention is to provide a spa apparatus that overcomes the above-noted disadvantages.

Another feature of the present invention is to provide a spa apparatus that does not require circulation pipes or pumps, thereby reducing the bacteria problem within the apparatus.

Another feature of the present invention is to provide a spa apparatus with a removable foot rest plate that allows for easy access to clean the spa components exposed to water.

Another feature of the present invention is to provide a spa apparatus that does not require tools to install and/or remove the foot plate and/or screen.

Another feature of the present invention is to provide a spa apparatus that minimizes the water fountain effect.

Another feature of the present invention is to provide a spa apparatus that includes a safety mechanism that stops the impeller from rotating when the screen or foot rest plate is removed.

A still further feature is to provide a spa apparatus with a removable foot rest plate that sealingly engages the bottom of a basin or the inner periphery of the basin and console to form a high pressure zone between the foot rest plate and the bottom of the basin.

Another feature is to provide a basin that is separate from the base of a spa apparatus.

Another feature still, is to provide a basin that may be moved up and down.

In still another feature a foot support is located within the basin and movable from an in-use position to a stored position.

Another feature is to provide a chair in a spa apparatus that may be tilted forward and rearward to permit easy entry and exit from the chair.

Another feature is to provide a chair that may be moved closer to or further from the basin.

Another feature is to provide a chair in a spa apparatus that swivels to allow easy entry and exit from the chair.

Another feature is to provide a chair that houses a flip up manicure assembly.

How these and other advantages and features of the present invention are accomplished (individually, collectively, or in various sub combinations) will be described in the following detailed description of the preferred and other exemplary embodiments, taken in conjunction with the FIGURES.

One embodiment of the invention provides a spa apparatus that includes a basin for retaining fluid. Further, the spa apparatus includes a foot rest plate removably positioned within the basin, the foot rest plate including a plurality of openings and at least one area without openings. The spa apparatus also includes an impeller coupled to the basin and a motor drivably coupled to the impeller.

Another embodiment of the invention provides a spa apparatus including a basin for retaining fluid. Further, the spa apparatus includes a foot rest plate removably positioned within the basin, the foot rest plate including a plurality of openings and at least one non-horizontal region. The spa apparatus also includes an impeller coupled to the basin and a motor drivably coupled to the impeller.

Another embodiment of the invention a basin for retaining fluid having a floor. A foot plate is operatively sealed to the basin. A first region is defined by an area between the foot plate and the floor of the basin. The foot plate includes an intake opening and at least one output opening. An impeller is located between a top surface of the plate and the floor of the basin and configured to draw fluid through the intake opening into the first region and to force the water out of the first region through the output opening.

In another embodiment, a water spa includes a basin configured to hold water. A removable foot rest plate having an upper surface is operatively secured to the basin below the free surface of the water. The foot rest plate includes an inlet opening and at least one output opening. A pump is configured to draw water through the inlet opening into a region below the foot rest plate and to distribute the water to the output opening under a pressure greater than the fluid pressure of the water above the foot rest plate.

Another embodiment of the invention provides a method of cleaning a spa apparatus including removing a foot rest plate from the spa apparatus. In addition, the method includes mechanically cleaning the spa apparatus with a cleanser, including each component exposed to fluid during use of the spa apparatus. Further, the method includes replacing the foot rest plate in the spa apparatus.

Another embodiment includes a spa apparatus including a base having a front end and a rear end. A basin for retaining fluid is supported on the base proximate the front end. A motor is connected to the basin for raising and lower the basin relative to a portion of the base. A chair is supported on the base; intermediate the basin and the rear end of the basin.

Another embodiment of a spa apparatus includes a base and a basin for retaining fluid. A chair is supported by the base and includes an actuator secured to a first portion of the chair and the base. The actuator is movable from a first position to a second position to tilt the chair from a first position to a forward tilted position to aid a person in exiting and/or entering the chair.

Another embodiment of a spa apparatus includes a base and a basin being separate from and secured to the base. A chair is also secured to the base.

Another spa apparatus includes a base and a chair being supported by the base. A basin for retaining fluid is supported by the base. The basin includes an outer wall defining an interior portion. The outer wall has an upper edge. At least one foot rest is operatively secured to the basin within the interior portion of the basin. The foot rest has a foot support located above the upper edge of the outer wall when the foot support is in an in-use position.

Another embodiment of the spa apparatus includes a chair having a pair of arms. Each arm includes a cavity therein. A manicure apparatus is secured to and removably stored within the cavity.

The present invention further relates to various features and combinations of features shown and described in the disclosed embodiments. Other ways in which the objects and features of the disclosed embodiments are accomplished will be described in the following specification or will become apparent to those skilled in the art after they have read this specification.

Figure 1:
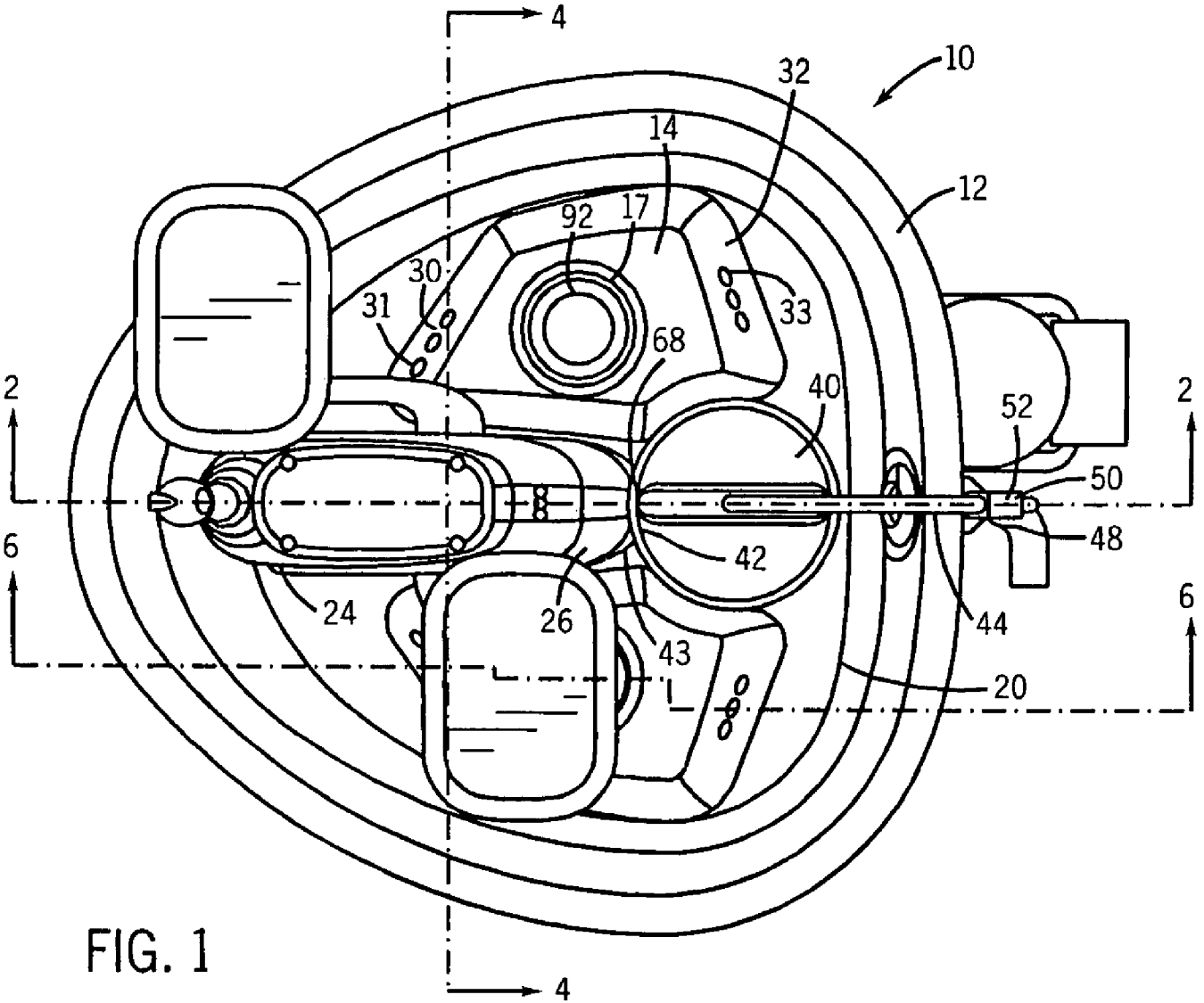
FIG. 1 is a top plan view of the spa apparatus according to an exemplary embodiment.

Before describing a number of preferred, exemplary, and alternative embodiments of the invention in detail, it is to be understood that the invention is not limited to the details of construction and the arrangement of the components set forth in the following description or illustrated in the drawings. The invention is capable of other embodiments or being practiced or carried out in various ways. It is also to be understood that the phraseology and terminology employed herein is for the purpose of description and should not be regarded as limiting.

DETAILED DESCRIPTION OF PREFERRED AND OTHER EXEMPLARY EMBODIMENTS

Before proceeding to the detailed description of the preferred and exemplary embodiments, several comments can be made about the general applicability and the scope thereof.

First, while the components of the disclosed embodiments will be illustrated as a spa apparatus designed for feet or foot spas, the features of the disclosed embodiments have a much wider applicability. For example, the spa design is adaptable for other spa devices including spas for hands, other body parts, entire bodies, etc. Further, the size of the various components and the size of the apparatus can be widely varied.

Second, the particular materials used to construct the exemplary embodiments are also illustrative. For example, the basin of the spa apparatus may be made from a scratch resistant material such as borosilicate or other suitable material. Further, components of the spa apparatus can be manufactured from thermoplastic resins such as injection molded high density polyethylene, polypropylene, other polyethylenes, acrylonitrile butadiene styrene ("ABS"), polyurethane, nylon, any of a variety of homopolymer plastics, copolymer plastics, plastics with special additives, filled plastics, etc. Also, other molding operations may be used to form these components, such as blow molding, rotational molding, etc. In addition, various components of the spa apparatus can be manufactured from stamped alloy materials such as steel or aluminum.

Proceeding now to descriptions of the preferred and exemplary embodiments, FIGS. 1-7 show spa apparatus 10 according to a preferred embodiment. Spa apparatus 10 is configured for use in foot massages, pedicures, and other activities related to the feet, including bathing, soaking, stimulating, etc.

Spa apparatus 10 includes a basin 12 configured to retain fluid (e.g., water) for use with various cleaning and/or massage activities. Spa apparatus 10 also includes a foot rest plate 14 positioned within the basin, an impeller 16 coupled to basin 12, and a motor 18 located external to the basin for rotating impeller 16 so that fluid is directed through foot rest plate 14.

Figure 3:
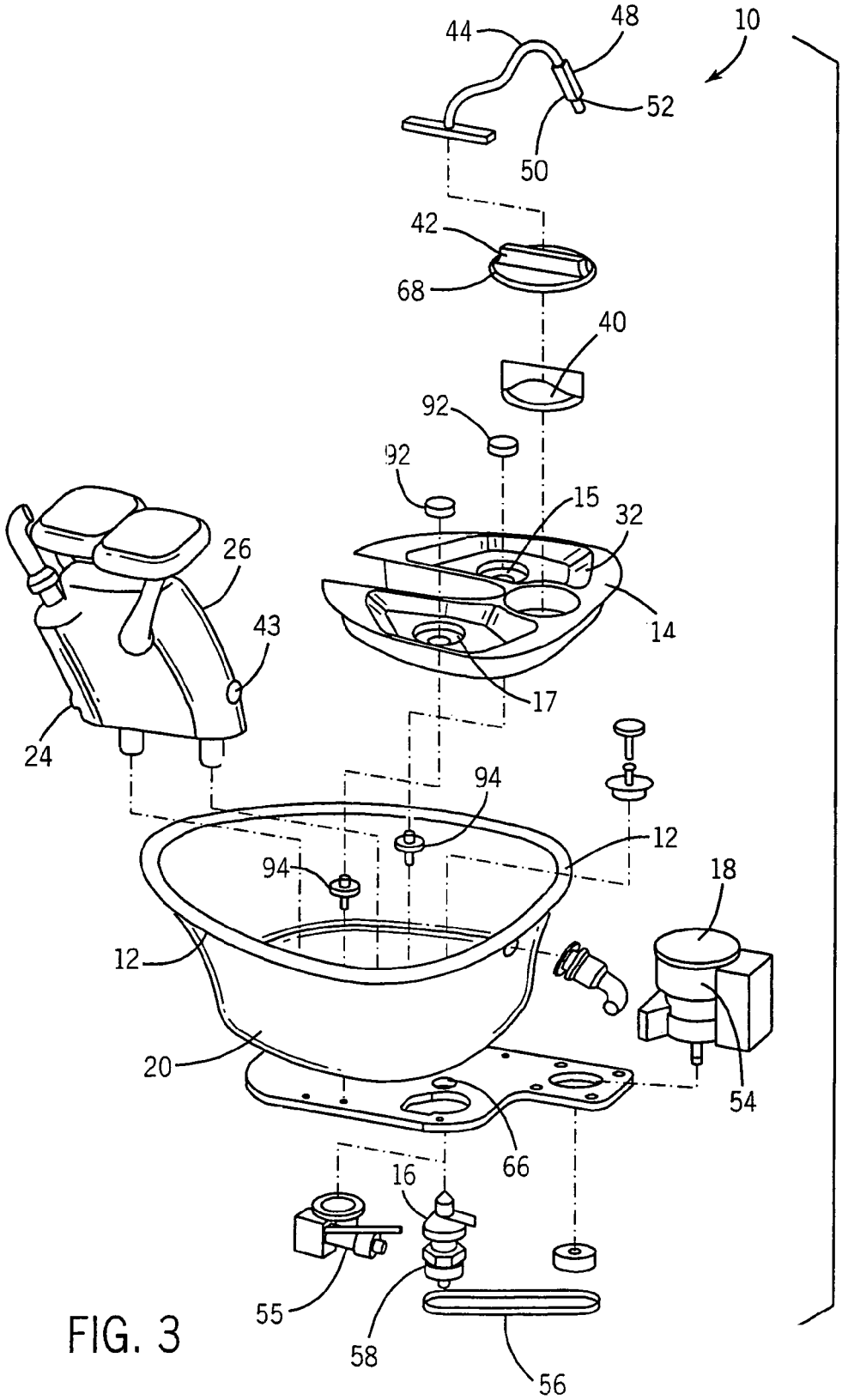
FIG. 3 is an exploded perspective view of the spa apparatus according to an exemplary embodiment.
Figure 4:
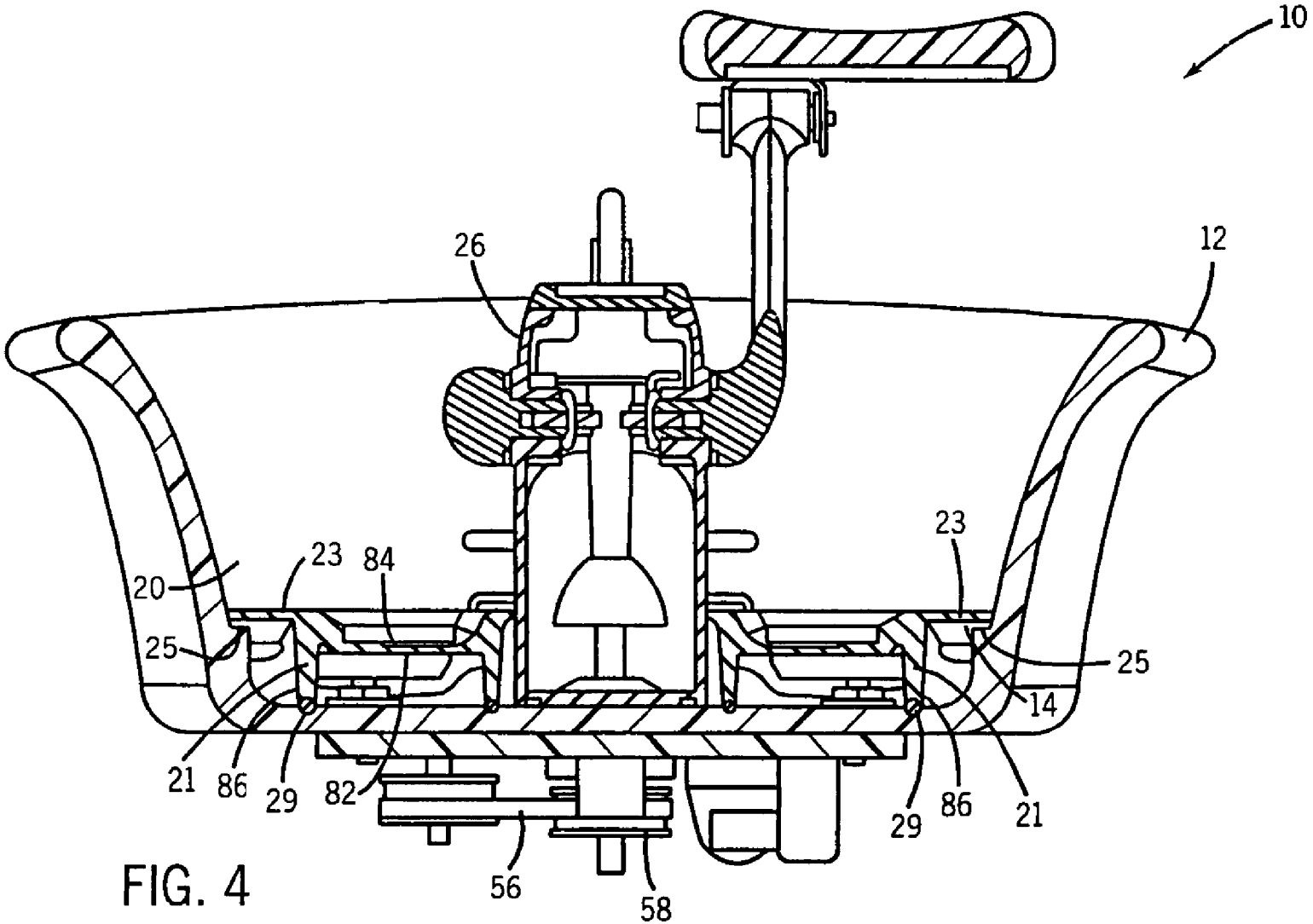
FIG. 4 is a sectional view of the spa apparatus taken along line 4-4 of FIG. 1.
Figure 5:
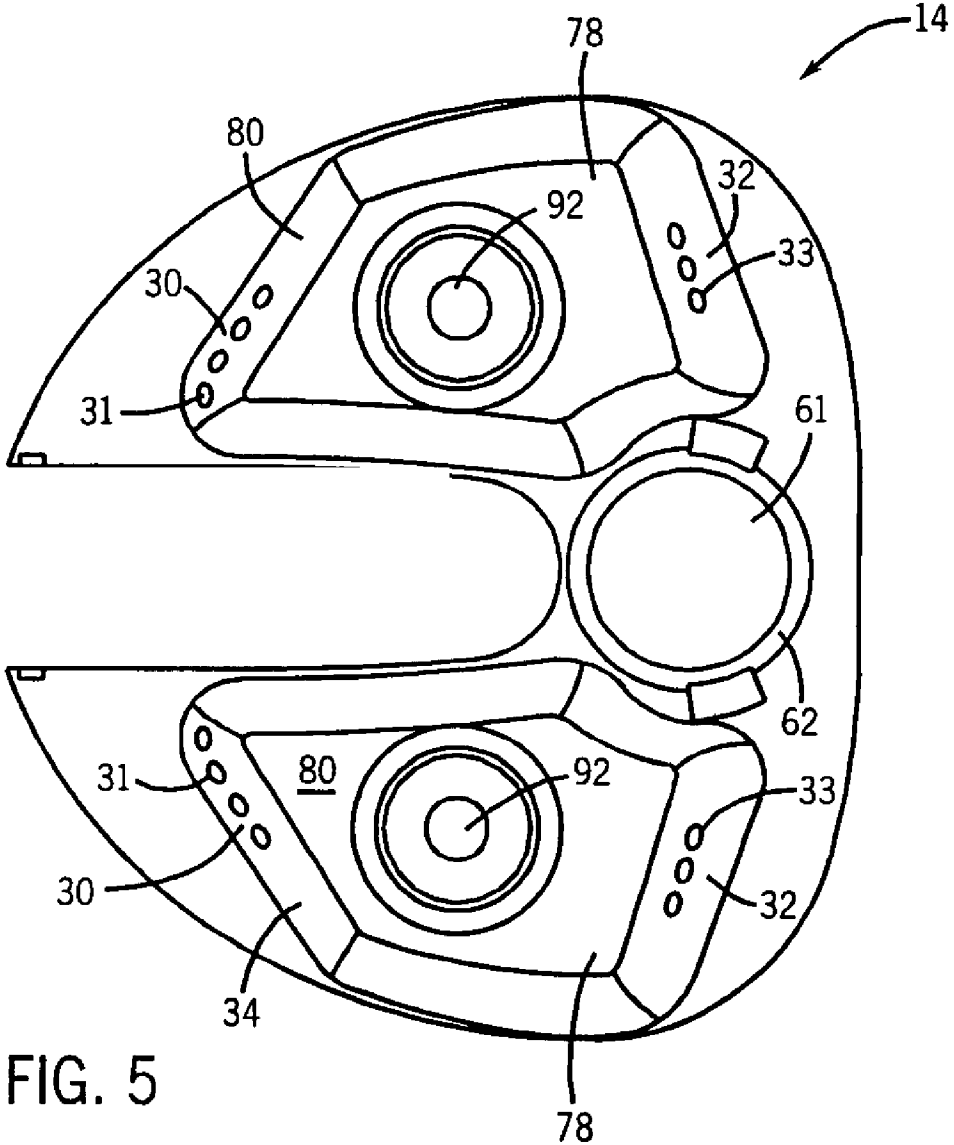
FIG. 5 is a top plan view of a foot rest plate according to an exemplary embodiment.
Figure 6:
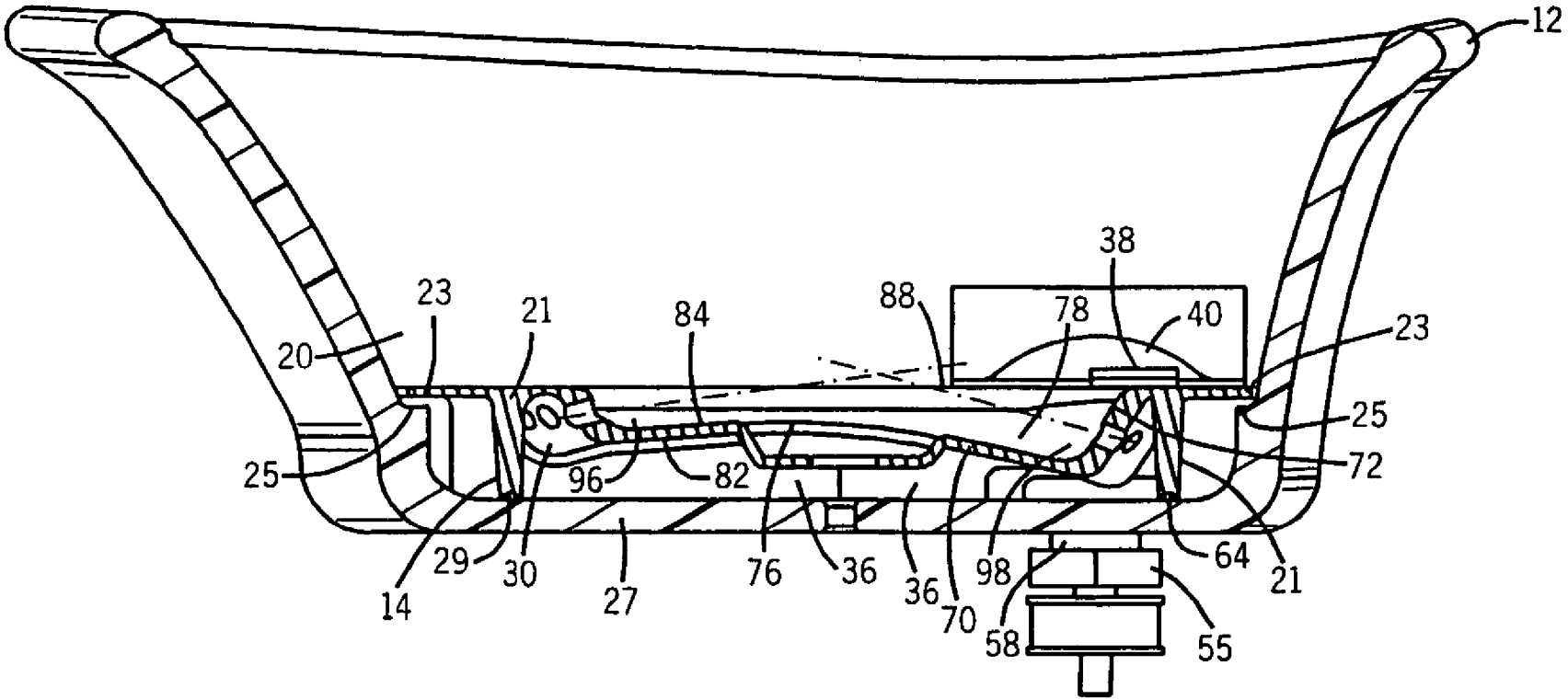
FIG. 6 is a sectional view of a foot rest plate taken along line 6-6 of FIG. 1.
Figure 7:
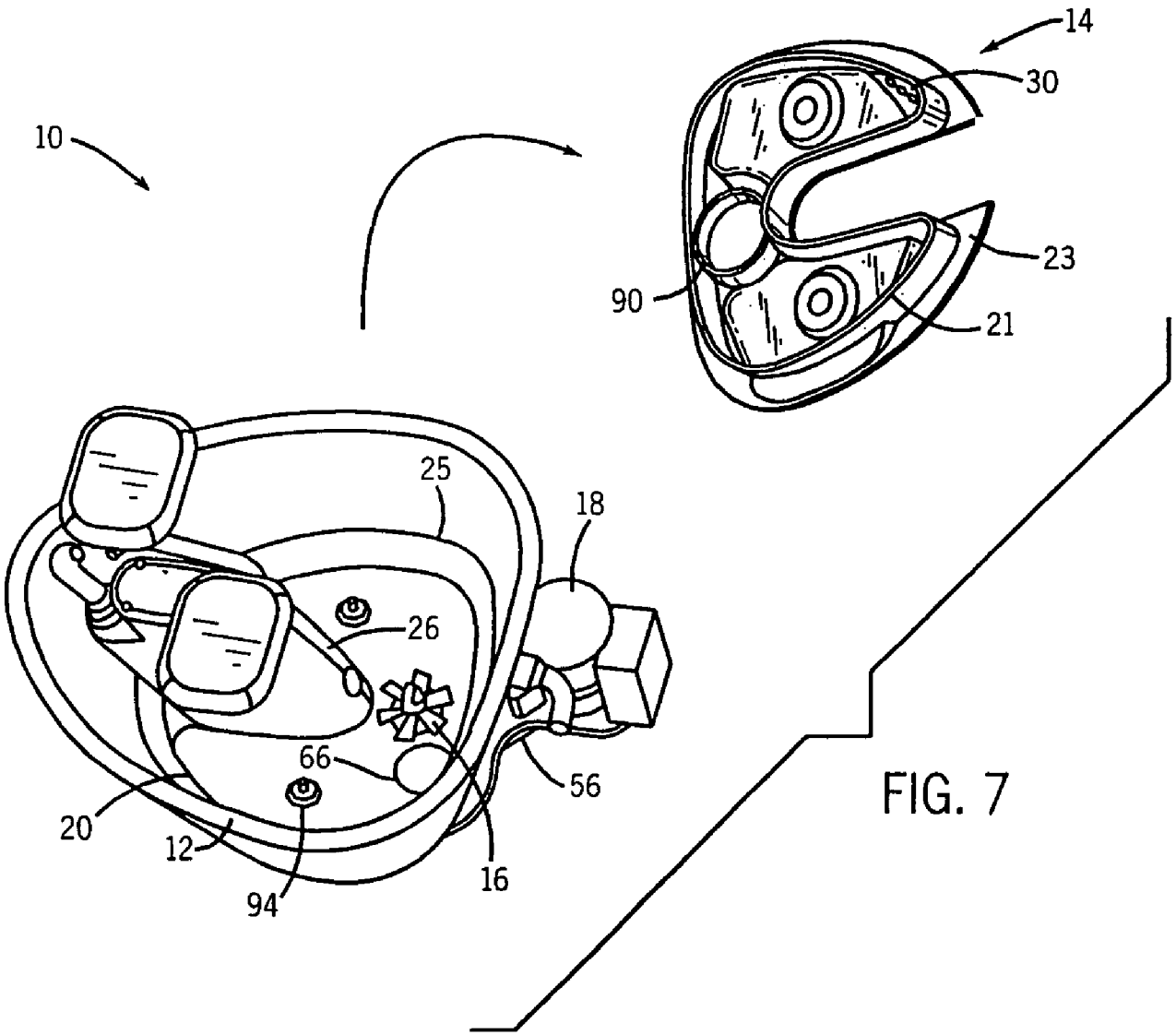
FIG. 7 is an exploded perspective view of the spa apparatus configured so that it may be cleaned according to an exemplary embodiment.
Figure 8:
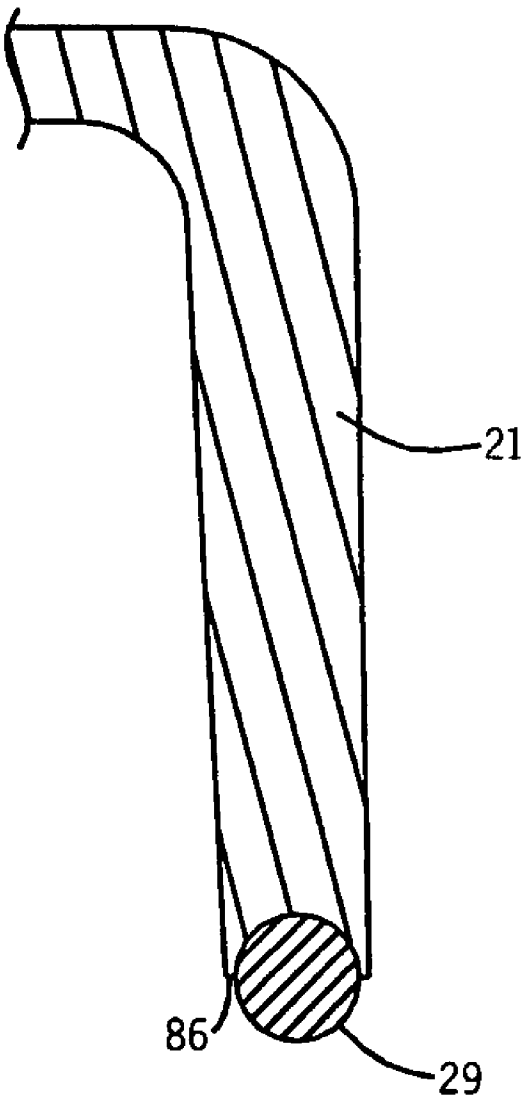
FIG. 8 is a partial sectional view of a foot rest plate taken generally along line 8-8 of FIG. 6.
Figure 9:
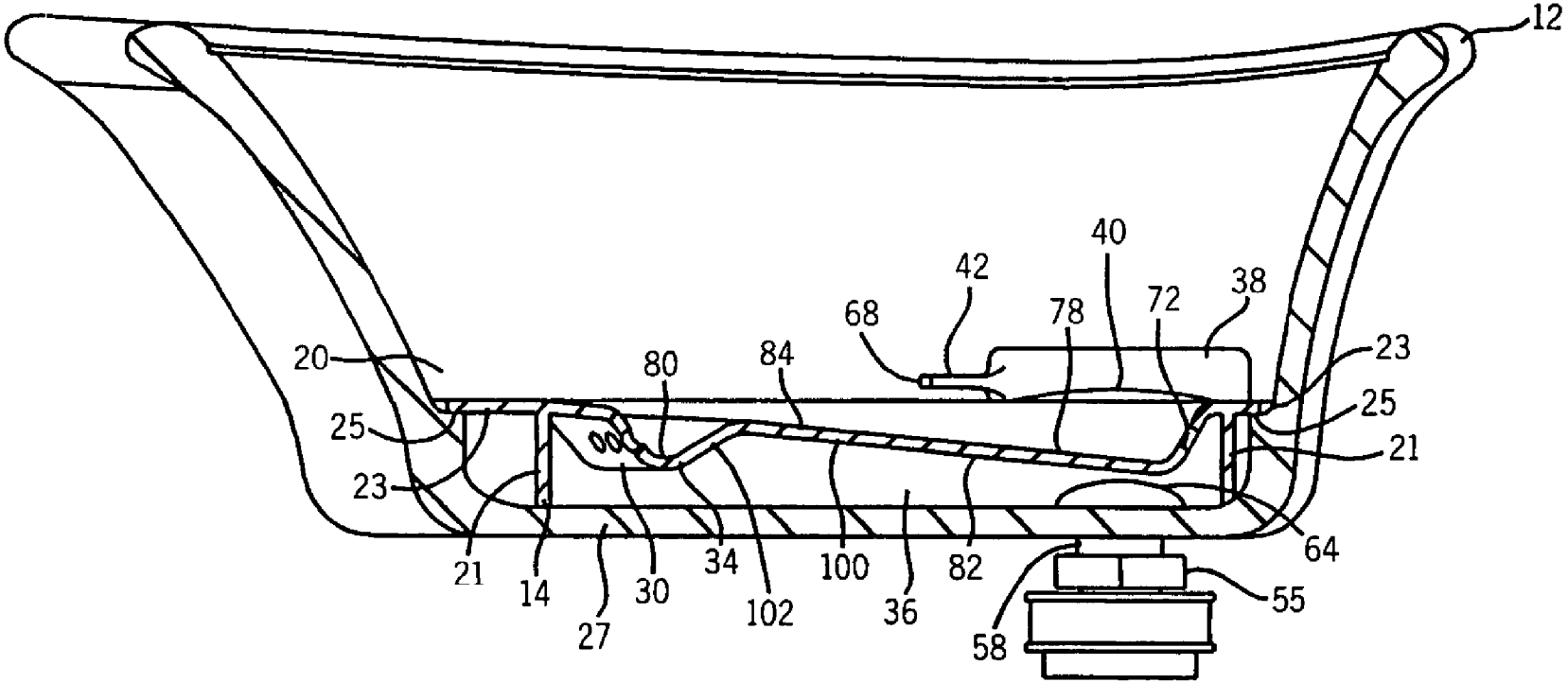
FIG. 9 is a sectional view of a foot rest plate according to an alternative embodiment.

Foot rest plate 14 is preferably positioned in the lower portion 20 of basin 12. According to an exemplary embodiment, foot rest plate 14 is removably coupled to basin 12 below the fluid surface, and in the preferred embodiment rests on the floor of basin 12. Foot rest plate 14 forms a seal with the floor or bottom surface 27 of basin 12 to restrict the flow of fluid around foot rest plate 14. Referring to FIGS. 6-8, foot rest plate 14 includes a lower ridge 21 having a neoprene sealing ring 29 located in a groove 86 to form a seal when foot rest plate 14 makes contact with basin 12. The seal may be formed between lower ridge 21 and bottom surface 27 of basin 12 and/or between upper ridge 23 and ledge 25 of basin 12. In a preferred embodiment, foot rest plate 14 is held in position within basin 12 by caps 92. As shown in FIG. 3, caps 92 are removably coupled to fasteners 94 which are fixedly attached to basin 12. Fasteners 94 are positioned in basin 12 to protrude through apertures 15 on foot rest plate 14 when foot rest plate 14 is positioned within basin 12. Foot rest plate 14 includes fastener cavities 17 where fasteners 94 and caps 92 may be coupled together without interfering with operation of apparatus 10. Caps 92 are coupled to fasteners 94 by threading caps 92 onto fasteners 94 until a desired seal is obtained. Caps 92 are coupled to fasteners 94 with sufficient force to secure foot rest plate 14 within basin 12 to prevent any leaking within apparatus 10 during operation of the system. Alternatively, caps 92 may be coupled to fasteners 94 by a variety of other methods such as, for example, clamping, screwing, hooking, clipping, snapping, etc. Caps 92 form seals with foot rest plate 14 after being coupled to fasteners 94. Similarly, fasteners 94 form seals with basin 12. According to an alternative embodiment as shown in FIG. 9, foot rest plate 14 may be held in position within basin 12 by a protrusion 24 on the side of a center console 26 that is positioned within basin 12. Alternatively, foot rest plate 14 may be held in position within basin 12 by various fastening or joining methods (e.g., fastening, clamping, hooking, sliding, etc.). According to a preferred embodiment, foot rest plate 14 is configured so that a user may easily remove plate 14 without tools. This allows a user easy access to mechanically clean (e.g., scrub with a cleanser such as water, soap, detergent, disinfectant, antiseptic, etc.) the components of spa apparatus 10 that are exposed to water.

In the particular embodiment illustrated, foot rest plate 14 includes a first nozzle system 30 and a second nozzle system 32. Nozzle system 30 is positioned on foot rest plate 14 to direct a stream of fluid in a non-vertical direction. Nozzle system 30 includes at least a first opening 31 configured to direct fluid in a non-vertical direction. More specifically, opening 31 is configured to direct a stream of fluid at the front of the foot, including the toes. Nozzle system 32 is positioned on foot rest plate 14 to direct a stream of fluid in a non-vertical direction. Nozzle system 32 includes at least a second opening 33 configured to direct fluid in a non-vertical direction. More specifically, opening 33 is configured to direct a stream of fluid at the back of the foot, including the heel. As used in this application, the vertical direction is a generally upward direction parallel to the vertical plane. Further, the vertical plane is perpendicular to the horizontal plane or the plane of resting fluid within the basin.

Foot rest plate 14 is configured so that users are able to move their feet to adjust the location of nozzle systems 30 and 32 relative to their feet. In effect, this allows users to control how the water exiting nozzle systems 30 and 32 makes contact with their feet. As shown in FIG. 6, foot rest plate 14 has an overall configuration that approximates the general shape and/or curvature of the human foot. First opening 31 of nozzle system 30 may be positioned at an angle 96 of about 0 to 30 degrees with respect to the horizontal plane. According to a preferred embodiment, water exits first opening 31 at an angle 96 of about 8 degrees with respect to the horizontal plane. Additionally, second opening 33 may be positioned such that water may exit at an angle 98 of about 0 to 40 degrees. According to a preferred embodiment, water exits second opening 33 at an angle 98 of about 15 degrees with respect to the horizontal plane. Further, by placing the first opening 31 and the second opening 33 at the described angles and having the two streams of fluid collide near the center of the basin, the water fountain effect can be greatly diminished. For example, when openings 31 and 33 are positioned directly opposite one another so that the fluid streams intersect and have a canceling effect on each other, the resultant fluid stream vector has a minimized vertical component. Consequently, splashing from the spa apparatus is greatly diminished. Alternatively, openings 31 and 33 may be positioned so that the resultant fluid flows do not directly intersect. For example, openings 31 and 33 may be positioned so that the fluid exiting openings 31 and 33 are parallel to one another. This may be accomplished by offsetting openings 31 and 33 so they do not lie directly opposite one another, directing openings 31 and 33 to produce parallel flows, etc.

Further, openings 31 and 33 are arranged in a non-uniform pattern on foot rest plate 14. As used in this application, the term "uniform" means consistent throughout an entire area. For example, screens and grids are often characterized by uniform perforations or openings over the entire surface of the screen or grid. Each opening or perforation is generally uniform in shape and distribution throughout the object. Since foot rest plate 14 has a non-uniform pattern of openings, plate 14 includes at least one area without any perforation or openings. In other words, foot rest plate 14 does not have an even and continuous distribution of openings across its entire surface.

Foot rest plate 14 serves several purposes. For example, foot rest plate 14 provides support for the foot at a desired angle for comfort. In addition, foot rest plate 14 protects the foot from contact with the rotating impeller housed beneath it. Further, foot rest plate 14 confines, constricts, and directs the flow of water from impeller 16 to nozzle systems 30 and 32 formed in the foot rest plate. Furthermore, foot rest plate 14 also serves to divide basin 12 into a high pressure zone 36 and a low pressure zone 38. The high pressure zone 36 is located between basin 12 and the bottom of foot rest plate 14 whereas low pressure zone 38 is located above the top of foot rest plate 14. Consequently, the cavity formed between basin 12 and foot rest plate 14 (e.g., high pressure zone 36) takes the place of, and in effect replaces the pipes in a conventional pipe system.

Figure 2:
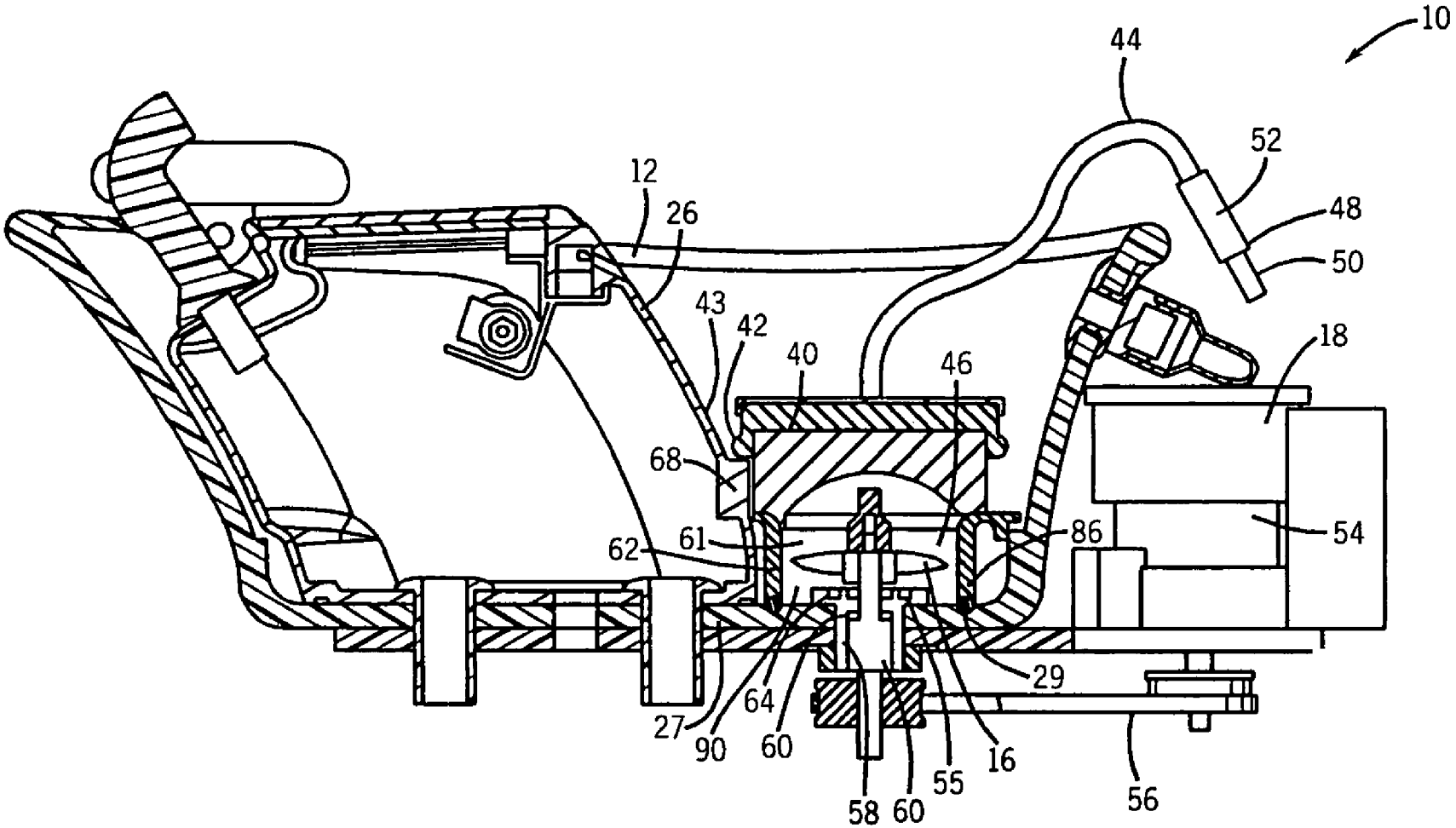
FIG. 2 is a sectional view of the spa apparatus taken along line 2-2 of FIG. 1.

A screen 40 is configured to be positioned over the opening of inlet or intake 61 of foot rest plate 14 and is coupled to console 26 and/or foot rest plate 14. Referring to FIG. 2, tab 42 on screen 40 abuts edge 43 on console 26. Alternatively, screen 40 may be coupled to foot rest plate 14 and/or console 26 by various fastening or joining methods (e.g., fastening, clamping, hooking, sliding, etc.). Alternatively, screen 40 may be integrally formed as part of a single unitary body with foot rest plate 14 and/or console 26. Moreover, in alternative embodiments, screen 40 may be omitted or replaced by one or more openings.

In one embodiment foot spa apparatus 10 may include an air line 44 coupled to screen 40 to control the outflow of air mixed in the fluid streams through nozzle systems 30 and 32. According to an exemplary embodiment, air line 44 may comprise a hose or standpipe. According to alternative embodiments, air line 44 may comprise other devices (e.g., cylinders, pipettes, pipes, lines, inlets, channels, etc.). Air line 44 is generally positioned to bring air to the low pressure side 46 of impeller 16 and to mix air into the fluid stream. In addition, air line 44 may include a valve 48 to regulate the amount of air in the fluid stream. In the particular embodiment illustrated, valve 48 is controlled by an air line switch 50 located on a handset 52. Alternatively, valve 48 may be controlled by other electronic or mechanical devices (e.g., button, knob, etc.). Moreover, in alternative embodiments, air line 44 and/or valve 48 may be omitted.

According to an exemplary embodiment, spa apparatus 10 includes a motor 18. Motor 18 may be enclosed in a motor housing 54 and coupled to belt 56 so that when motor 18 operates, belt 56 rotates in a cyclical manner. Belt 56 may also be coupled to a shaft 58 which is supported by bearings 60 and secured within a shaft housing 55. Shaft 58 is further coupled to impeller 16 so that the cyclical rotation of belt 56 also rotates impeller 16. Consequently, the rotation of impeller 16 causes the fluid to be drawn in through screen 40 and out through nozzle systems 30 and 32.

Referring to FIG. 3, spa apparatus 10 may include a circular duct 62 that can either be coupled to impeller 16 or to foot rest plate 14 proximate the opening of inlet or intake 61. The circular duct acts to confine the water flow around impeller 16. Circular duct 62 may extend from the opening of inlet 61 and extend downward surrounding impeller 16. Circular duct 62 includes a lower edge 90 that is located a predetermined distance above the floor 27 to allow water being drawn into inlet 61 to be guided downward through the duct 62 into zone 36 and out of openings 31 and 33. It is possible to couple the circular duct 62 directly to the ends of the impeller blades, such that the duct 62 rotates with the impeller 16. In this embodiment, the duct should be located as close as possible to the opening of inlet 61 and to the circumference of the opening.

A duct seal 64 coupled to basin 12 and shaft housing 55 also keeps the fluid in basin 12 from escaping out of the apparatus. Spa apparatus 10 may also include a drain 66 for releasing at least some of the fluid from basin 12. Drain 66 is located on the lower portion 20 of basin 12.

A sensor switch 68 is located within apparatus 10 senses when foot rest plate 14 is in position. In addition, sensor switch 68 senses when screen 40 is in position. Upon sensing that either screen 40 or foot rest plate 14 are out of position, sensor switch 68 shuts off power to motor 18 to prevent the operation of motor 18. Sensor switch 68, therefore, acts as a safety mechanism to reduce the risk of accidental injury caused by the operation of impeller 16.

Referring to FIGS. 3 and 6, foot rest plate 14 is configured so that a foot may rest at an angle relative to the horizontal plane within spa apparatus 10. Referring to FIG. 6, foot rest plate 14 includes radiused surface 70 that supports the foot during operation of apparatus 10. According to a preferred embodiment, radiused surface 70 has a radius of about 20 inches. Further, radiused surface 70 is about 10 inches in length. Of course the length of radiused surface 70 could be longer or shorter to accommodate variations in size of most feet. Foot rest plate 14 may also include backing 72 to further support a user's heel. Backing 72 may be configured at an angle for added comfort. According to a preferred embodiment, backing 72 is configured at an angle of about 15 degrees with respect to the horizontal plane. Further, backing 72 is about 3 inches in length.

Radius 76 enables a user to position their toes within the stream of water exiting opening 31 according to the user's desired configuration. For example, depending on the position of a user's foot, the stream of water may flow against the toes, over the foot, under the foot, around the foot, etc. The location and angle of the foot determines how the stream of water flows relative to the foot. Radius 76 extends from radiused surface 70 to create toe region 80. According to a preferred embodiment, heel region 78 is positioned lower than toe region 80 so that a user may angle their foot upward from heel to toes.

The operation of spa apparatus 10 will now be described. According to a preferred embodiment, foot rest plate 14 is positioned within basin 12 prior to use such that neoprene sealing ring 29 comes into contact with the floor 27 of basin 12. As a result zone 36 is formed between the underside 82 of foot rest plate 14, the lower ridges 21, and the floor 27 of basin 12. Fluid is placed in basin 12 up to a desired level above the upper surface 84 of foot rest 14. Prior to operation of motor 18, water will fill zone 36 by entering through openings 31 and 33 and through intake 61. Operation of motor 18 causes impeller 16 to rotate and consequently draw fluid from basin 12 through screen 40 and inlet 61 through circular duct 62 and into zone 36. The rotation of impeller 16 creates a low pressure zone 38 above foot rest plate 14 and a high pressure zone 36 below foot rest plate 14. This difference in pressure causes the fluid to move from basin 12 down through circular duct 62 and eventually out through openings 31 and 33. Further, the shape and angles of foot rest plate 14 guide the exiting fluid from opening 31 against, under, over, and around the front of a user's foot positioned within spa apparatus 10. Similarly, the shape and angles of foot rest plate 14 guide the exiting fluid from opening 33 against the back of the heel and around the foot.

In one embodiment, the pressure differential between the high pressure zone 36 and low pressure zone 38 is approximately two psi. Of course the pressure differential may be greater than or less than two psi and may be adjusted. However, pressure substantially above two psi results in a flow that is turbulent and may also result in an uncomfortable effect on a user's feet. In one embodiment, water is circulated at 60 gpm with approximately 4.3 gpm through each of openings 31, 33. Of course other pressure differentials and flow rates may be selected by increasing the speed of the impeller or the size and/or number of openings 31, 33.

As described above in a preferred embodiment, water exits opening 31 at an angle of about 8 degrees with respect to the horizontal plane. This angle allows the water to be directed over the top of a user's foot if the user's foot is moved back toward opening 33 at the heel region. By moving one's foot away from the heel region and toward nozzle system 31, the water from opening 31 may be directed under the toes or heel of one's foot. This allows the user to determine where the water exiting the opening 31 should be directed. The recessed location of opening 31 due to the curvature and/or shape of foot rest plate 14 makes it difficult for a user to block the openings thereby disrupting the balance of the water flow. Additionally it is believed that being too close to the opening does not produce a pleasant affect. The location of opening 31 and the shape of foot rest plate 14 help ensure that a user's foot will not entirely come into contact with the openings during operation of the system. Water exits opening 33 an angle of about 15 degrees relative to the horizontal plane. Referring to FIG. 6, the stream of water exiting opening 31 forms an included angle 88 of 23 degrees with the stream of water exiting from opening 33.

Referring to FIG. 9, in an alternative embodiment, foot rest plate 14 may include recessed cavity 34 where nozzle system 30 is located. Recessed cavity 34 allows nozzle system 30 to direct a stream of fluid in a non-vertical direction and makes it difficult for a user to block the openings thereby disrupting the balance of the water flow. In addition, foot rest plate may include incline surface 100 and slope 102. Incline surface 100 and slope 102 help support the foot during operation of apparatus 10.

During cleaning of spa apparatus 10, foot rest plate 14 may be easily and conveniently removed from basin 12 without the use of tools. Referring to FIG. 7, drain 66 may be opened before foot rest plate 14 is removed so that fluid flows out of basin 12. Caps 92 may then be removed from fasteners 94. Similarly, screen 40 may then be removed by moving tab 42 so that it no longer abuts edge 43 on console 26. After removing caps 92 and/or screen 40, foot rest plate 14 may be lifted out of position from within basin 12. After foot rest plate 14 has been removed, spa apparatus 10 may be mechanically scrubbed and cleaned. The ability to remove foot rest plate 14 enables a user to quickly and efficiently clean each piece of apparatus 10 that comes into contact with fluid during operation, including impeller 16, basin 12, console 26, foot rest plate 14, etc. After cleaning apparatus 10, basin 12 and the other components may be rinsed out. Once apparatus 10 is cleaned, foot rest plate 14 may easily be re-positioned back within basin 12. After foot rest plate 14 has been positioned within basin 12, caps 92 may be coupled to fasteners 94 to retain foot rest plate 14 in position. Similarly, screen 40 may be positioned over inlet 61 of foot rest plate 14 and coupled to console 26 and/or foot rest plate 14. Apparatus 10 may be cleaned as needed to maintain the desired water quality.

Figure 10:
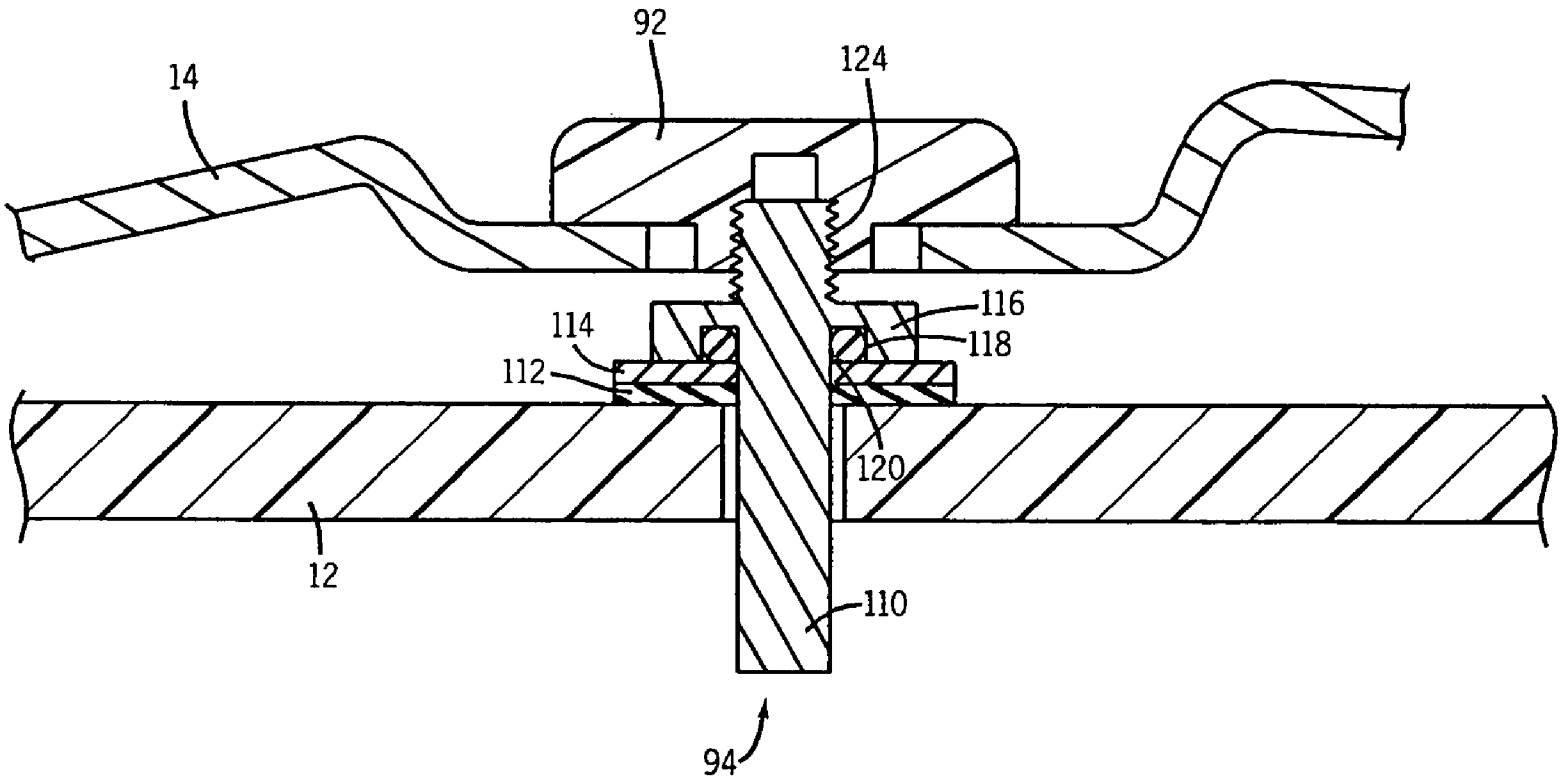
FIG. 10 is a cross-sectional view of the fastener for the foot rest plate of FIG. 6.
Figure 11:
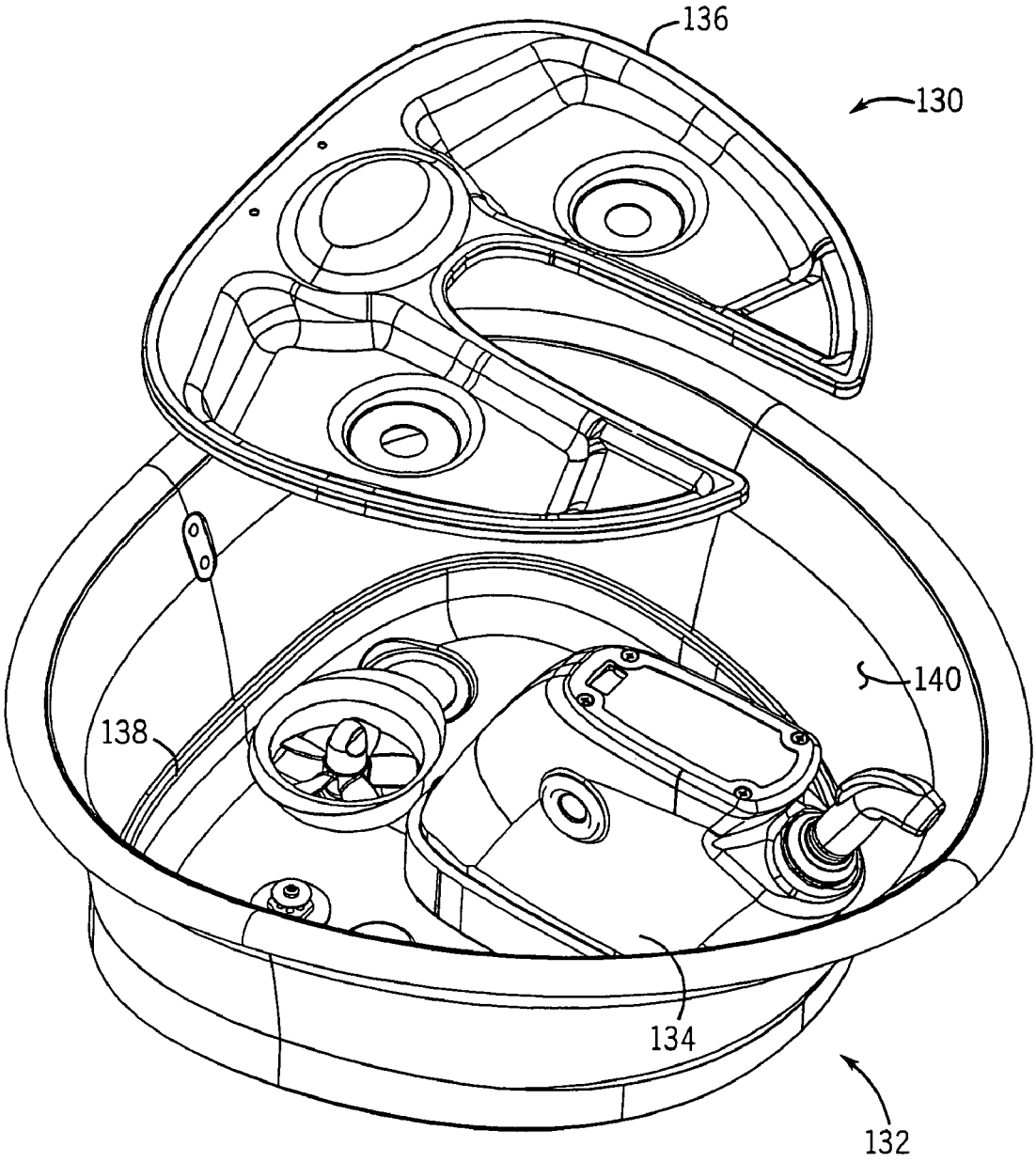
FIG. 11 is an exploded perspective view of an another foot rest plate and basin.

Referring to FIG. 10, fastener 94 includes stud 110 which extends through basin 12. Stud 110 includes a shoulder portion 116 which has a circular groove 120. Circular groove 120 houses an O-ring 118 to act as a seal to prevent water from flowing between stud 110 and basin 12. Further, stud 110 and shoulder portion 116 are positioned to couple with steel washer 114 which couples with rubber washer 112. Rubber washer 112 couples with basin 12 and forms a seal to prevent water from leaking out of apparatus 10 during operation of the system. In addition, fasteners 94 include threaded portions 124. Stud 110 includes male threads whereas rubber cap 92 includes female threads. Rubber cap 92 may therefore be threaded onto the threaded portion 124 of fastener 94 to a desired tension. As rubber cap 92 is threaded onto fastener 94, a seal is formed between rubber cap 92 and foot rest 14. This seal prevents water from leaking between underside 82 and upper surface 84 of foot rest 14. Once cap 92 is attached to fastener 110, foot rest plate 14 may be retained in position so that foot rest 14 is not dislodged by the water pressure created during operation of apparatus 10.

As discussed above, foot plate 14 can be sealed to basin 12 along the bottom of foot plate 14 with an o-ring 29 or about the inner periphery of basin 12. Referring to FIGS. 11-15 another embodiment of sealing a foot plate 130 to a basin 132 includes forming a seal about both an inner periphery of basin 132, as well as about the outer periphery of a central console 134. In this embodiment, foot plate 130 is sealed exclusively about its outer periphery 136. Of course foot plate 130 could include another seal such as an o-ring along a floor portion of foot plate 130, or along a sealing surface similar to the lower end of ridge 21 extending from foot plate 14. In this embodiment, a first portion of outer periphery 136 of foot plate 130 rests upon a ledge 138 extending from the inner basin wall 140. A seal 142 is located between ledge 138 and the first portion of outer periphery 136 of foot plate 130. Foot plate 130 includes an opening 139 for receiving the console 134. Seal 142 is applied between foot plate 130 and ledge 138 of basin 132 around the first portion of outer periphery 136 of basin 132. Console 134 includes a ledge 144 that supports a second portion of outer periphery 136 of foot plate 130. A second seal 146 is placed between the second portion of outer periphery 136 of foot plate 130 proximate opening 139 and ledge 144 of the console 134. Any gap between seal 142 and second seal 146 may be plugged with any sealant known in the art. This sealant may be an epoxy or other such flexible or non-flexible material. The resultant seal between foot plate 130 and basin 132 and console 134 is sufficient to allow for a build up of pressure under foot plate 130 to allow water to exit the holes in the foot plate under sufficient pressure to provide agitation of the water. Foot plate 130 is secured to the basin floor 148 at two points 150, 152. The region between seals 142 and 146 and basin floor 148 form a pressurized region when the pump is engaged. The pump mechanism, and floor plate features described above with respect to FIGS. 1-10 may also be applied to foot plate 130 and basin 132 either alone or in combination.

The level of water in basin 132 extends between three and six inches above outer periphery 136 of foot plate 130, however the level of water could be less than three inches or greater than six inches. Accordingly, a lower portion of console 134 is submerged in the water. The lower portion of console 134 is hermetically sealed so that no water is able to enter within an interior region of console 134. The location of console 134 within basin 132 allows for easy access to the console by an operator or technician. Console 134 is secured to the basin floor by fasteners 154. Additional openings in basin floor allow plumbing and electrical connections to extend into the console. Console 134 includes a pair of foot supports 162; a spray nozzle 158; and controls 160 for raising and lowering the basin, moving the seat in a fore/aft direction; and an automatic cleaning cycle.

Figure 18:
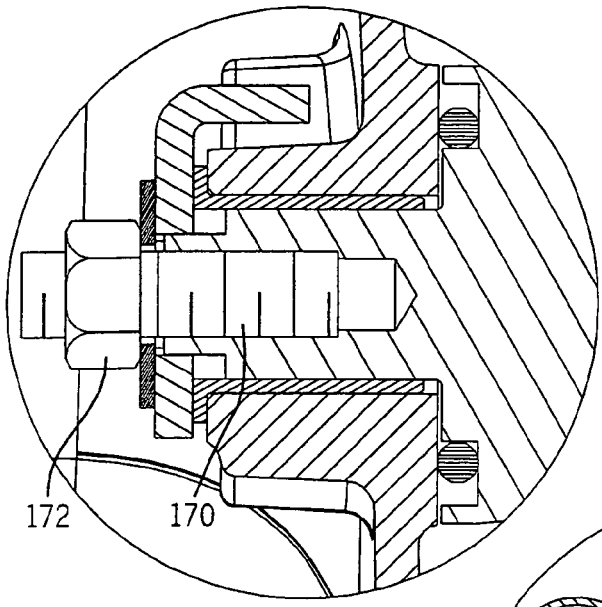
FIG. 18 is a close up view taken generally along line 18-18 of FIG. 17.
Figure 19:
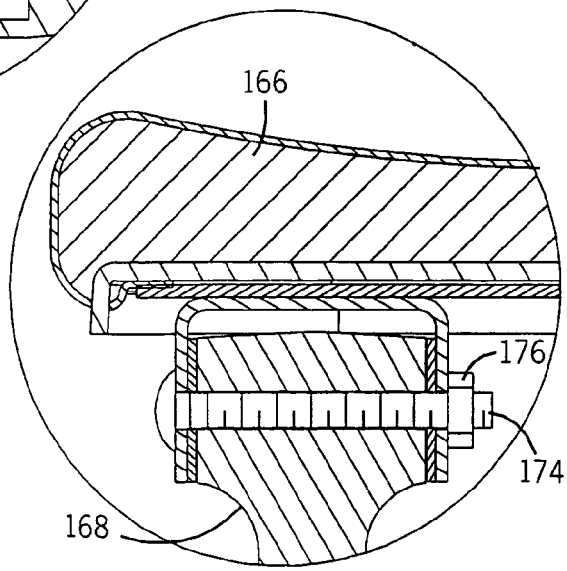
FIG. 19 is a close up view taken generally along line 19-19 of FIG. 17
Figure 17:
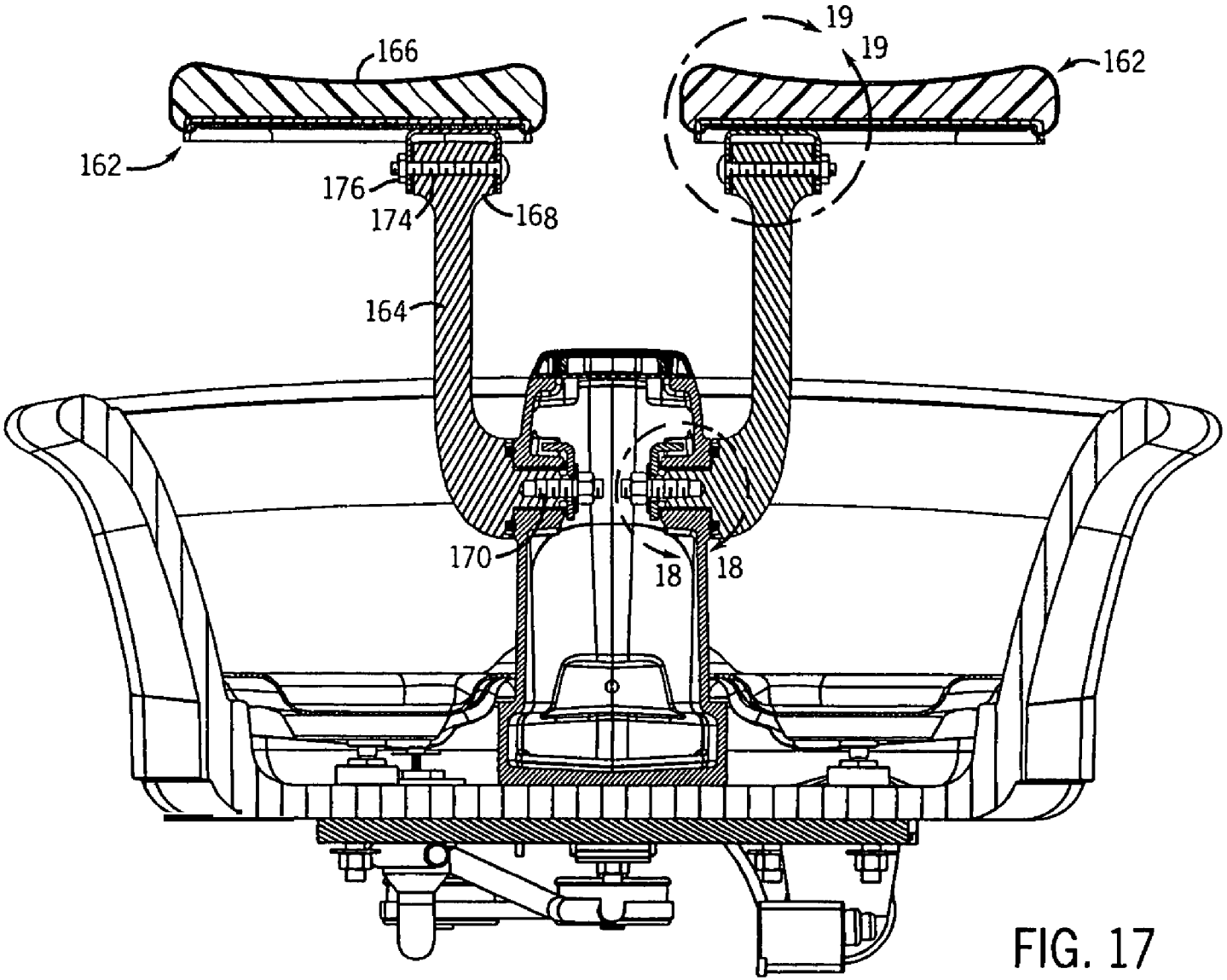
FIG. 17 is a sectional view of the basin and foot rest of FIG. 16.
Figure 20:
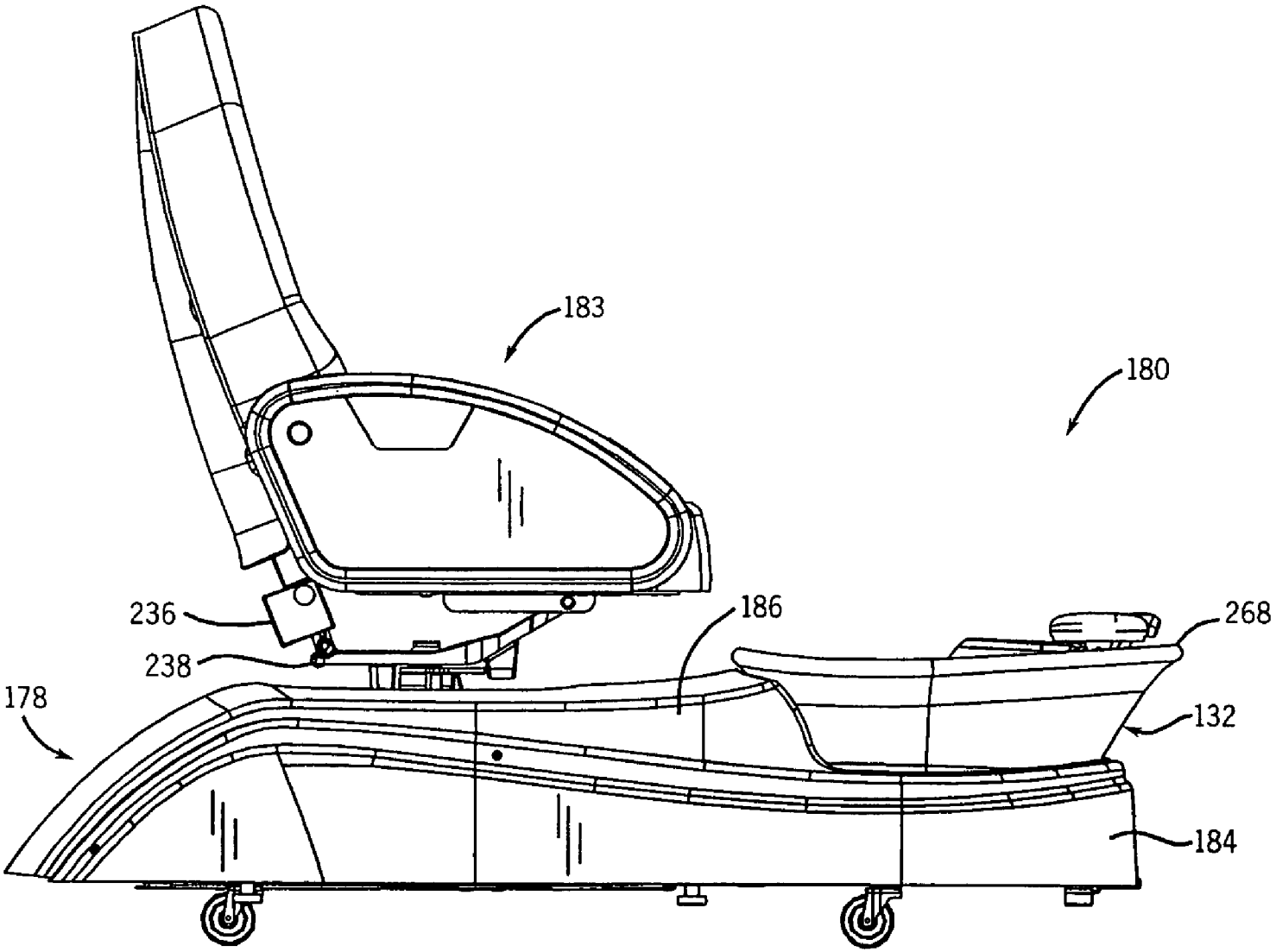
FIG. 20 is a side view of a spa assembly.
Figure 23:
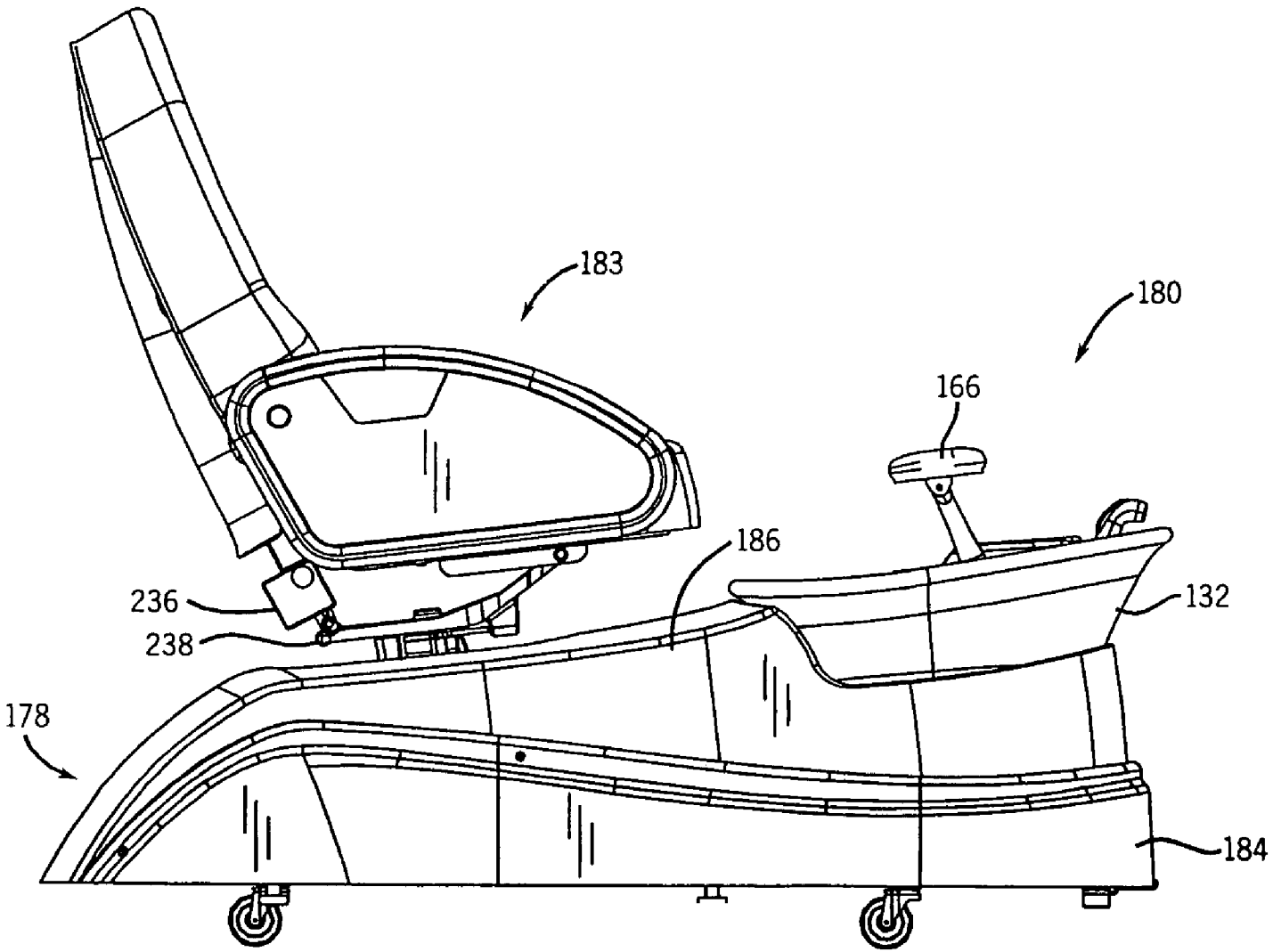
FIG. 23 is a side view of the spa assembly in a raised position.

When a technician works on a user's foot, the foot must be elevated out of the basin. The user's foot is typically held by the technician on his or her lap. This position may not be comfortable for either the user or the technician. Referring to FIGS. 17-19 a pair of foot supports 162 are pivotally attached to console 134. Each foot support 162 pivots independently of the other foot support 162 and can be moved between a first position in which foot support 162 is lowered to a second position in which foot support 162 is in a raised position. In one embodiment, foot support 162 includes an arm member 164 that is pivotally secured to console 134 at a first end. A cushioned support 166 is pivotally attached to a second end 168 of arm member 164 for supporting the calf of a user such that the user's foot extends toward the technician. Since foot supports 162 are located within the periphery of basin 132, the user can easily place the user's or calf upon foot support 162. Foot support 162 is held in place by friction. A first pivot 170 is secure to the first arm member 164 to console 134 with a fastener 172. Fastener 172 is adjustably tightened to provide sufficient frictional force to allow easy movement of foot support 162 while still providing sufficient force to maintain foot support 162 in a raised position when a user's foot or leg is resting on cushioned support 166. Similarly, cushioned support 166 is pivotally attached to arm 164 with a pivot pin 174 that is adjustably secured with a fastener 176 to provide a frictional force to allow the cushion support to maintain a horizontal orientation in both the lower and raised positions. Accordingly, the frictional force allows cushioned support 166 to be pivoted ninety degrees relative to arm member 164 as arm member 164 is moved from a horizontal to vertical position. Arm member 164 is substantially in a vertical position in the second or raised position and in a substantially horizontal position in the first or lowered position. Referring to FIG. 20, when foot support 162 is in the lowered position, cushioned support 166 is located proximate the basin edge and proximate the technician. Referring to FIG. 23, cushioned support 166 is located substantially above pivot 170 and distal the edge of the basin when foot support 162 is in the second or raised position.

Referring to FIG. 20, a spa assembly 180 includes a base 178; basin 132; and a chair 183. Base 178 supports both basin 132 and chair 183. Base 178 includes a frame 182 that is covered with a lower shroud 184 and an upper shroud 186. Spa assembly 180 includes a front 200 and an opposing rear 196. Basin 132 is positioned proximate front 200 and chair 183 is positioned between opposing rear 196 and basin 132. Basin 132 is movable between a first lowered position to a second raised position in which basin 132 is moved vertically upward eight inches. Of course, basin 132 may be moved in an upward direction more or less than eight inches.

Figure 21:
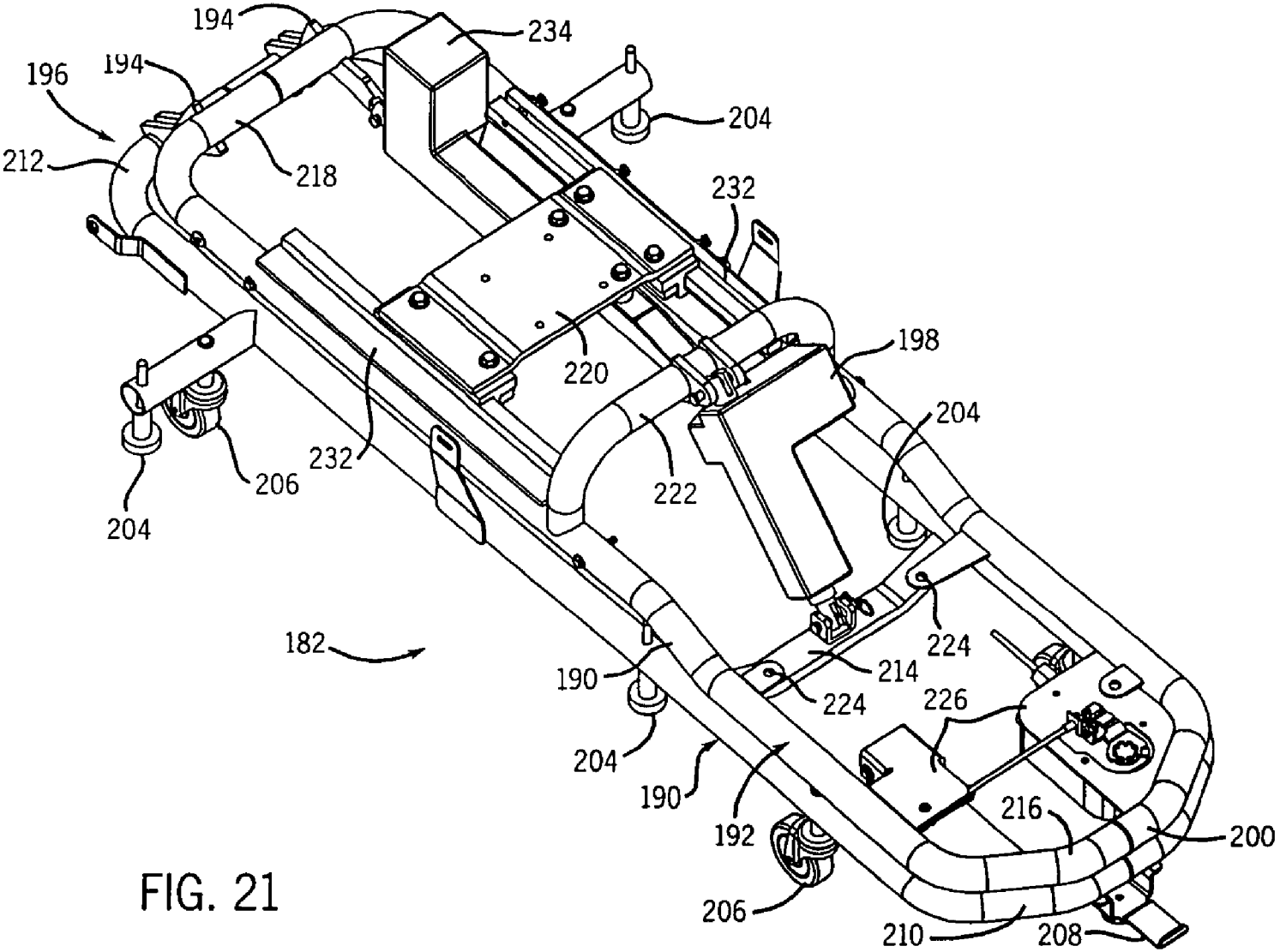
FIG. 21 is perspective view of a base frame.
Figure 22:
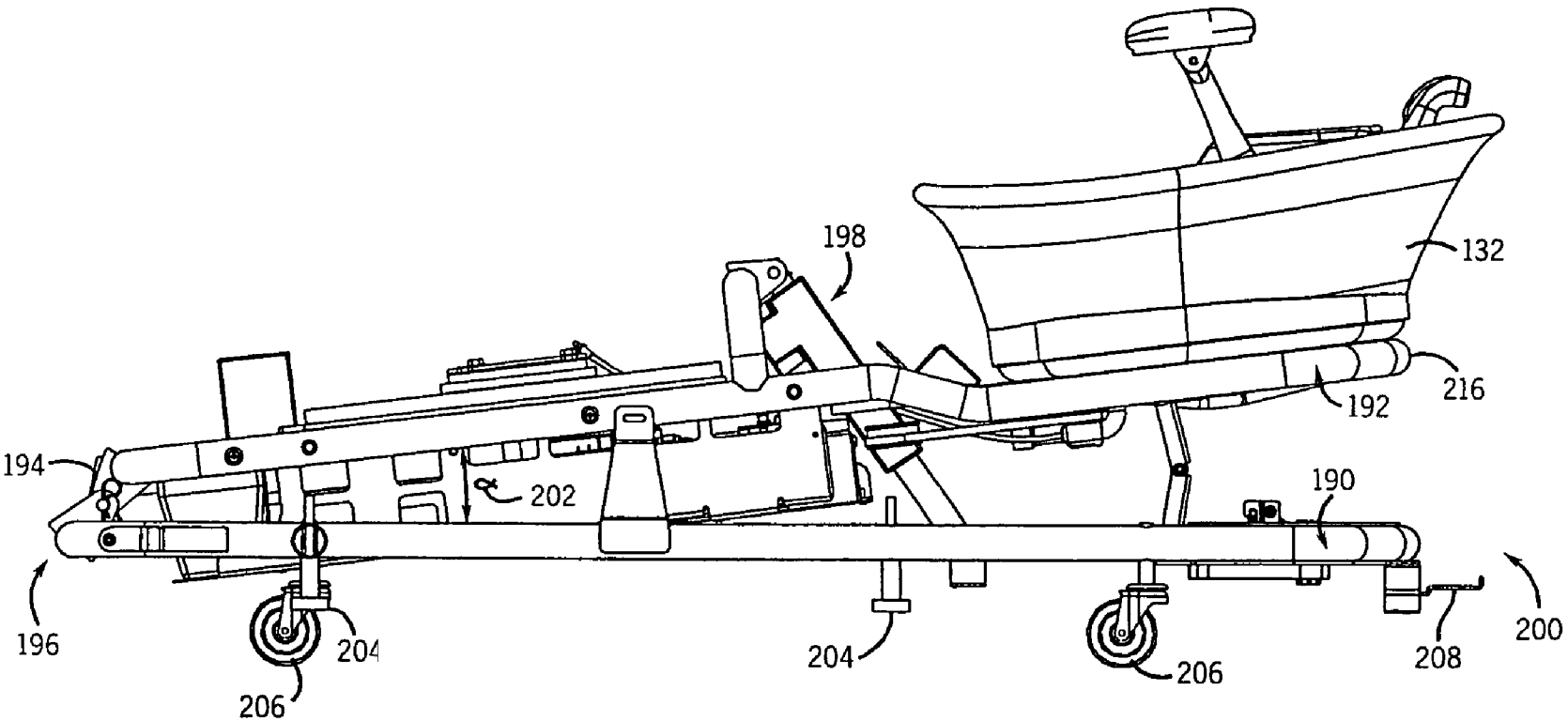
FIG. 22 is a side view of the base frame in a raised position.

Referring to FIGS. 21-22 frame 182 includes a lower support 190 and an upper support 192 pivotally attached to one another with a pair of bearings or pivots 194 proximate a rear end 196 of frame 182. An actuator 198 connects the upper and lower supports 190, 192 intermediate the rear end 196 and basin 132 such that actuation of actuator 198 causes a front end 200 of upper support 192 to raise relative to lower support 190. The rear end of upper support 192 pivots within bearings 194 that are secured to lower support 190. In a preferred embodiment, the front end of the upper support 192 moves in an upward direction away from the lower support 190 such that basin 132 is raised vertically eight inches. In one embodiment, the length of frame 182 as measured from rear end 196 to front end 200 is 64 inches. Accordingly, in this embodiment an angle 202 formed between the upper and lower supports 190, 192 is seven degrees when basin 132 is raised seven inches.

Lower support 190 is supported by a plurality of spaced feet 204 that may be adjustable to provide proper alignment of frame 182. A plurality of casters 206 are also provided to allow for easy movement and installation of spa 180. An extension 208 is provided on one of the ends of the frame to permit a jack having an upwardly extending handle to be removeably coupled to extension 208 to permit an installer to easily move spa 180. The jack may include at least one wheel to aide in the movement of the spa. Lower support 190 may include a front and a rear cross member 210, and 212 as well as a cross member 214 to provide structural stability and support for other components. Similarly, upper support 192 includes a front and rear cross member 216, 218 as well as intermediate cross members 220, 222. Actuator 198 is secured to cross members 214, 222 of lower and upper supports 190, 192 respectively. Referring to FIGS. 21 and 22, basin 132 is supported by upper support 192 at members 224 and 226. Chair 183 is secured to cross member 220 of upper support 192, such that when actuator 198 is fully activated to a raised position, chair 183 is raised upwardly along with basin 132. Since chair 183 is located closer to pivots 194 chair 183 is raised vertically less than basin 132. In one embodiment chair 183 is located approximately ten inches from pivot 194 when chair 183 is moved rearward toward pivot 194. In one embodiment, chair 183 is movable twelve inches further away or up to twenty two inches from pivot 194. Of course the chair may be movable closer to and/or further away from pivot 194.

Referring to FIGS. 20 and 23 chair 183 and basin 132 move up and down together as the upper support 192 is pivoted relative to lower support 190. Chair 183 includes a seat cushion 228 and a back cushion 230. Since, the rear end of upper support 192 is fixed relative to the rear end of lower support 190, chair 183 is also pivoted about bearings 194. As a result seat cushion 228 and back cushion 230 tilt towards the rear end seven degrees when upper support 192 is at an angle of seven degrees with respect to lower support 190.

Since chair 183 and basin 132 are both connected to upper support 192, the relative position of chair 183 and basin 132 remain constant. This constant relation allows the user to have a fixed position of the user's feet in basin 132. If basin 132 is moved independent of chair 183, then the user would have to reposition oneself in order to have his or her feet remain in the same position relative to basin 132. Since chair 183 also moves, the angle of the seat will change. Additionally, as upper support 192 is pivoted relative to the lower support 190 so that basin 132 is raised to allow a technician to work on the user's feet, the user is moved to a more reclined position in chair 183 adding to the comfort of the user.

Referring to FIGS. 20 and 23, frame 182 is covered by a lower shroud 184 and an upper shroud 186. Lower shroud 184 is secured to lower support 190 and upper shroud 186 is secured to the upper support 192. Upper and lower shrouds 186, 184 are telescopingly engaged such that as basin 132 is raised and lowered upper shroud 186 moves up and down relative to lower shroud 184. Upper and lower shrouds 186, 184 overlap a sufficient distance, such that no gap appears between upper and lower shrouds 186, 184 when basin 132 is in a fully raised position. In an exemplary embodiment, upper shroud 186 and lower shroud 184 are rigid members formed of fiberglass. Alternatively, either one or both of shrouds 184, 186 could be formed of a flexible material or telescoping material such as a corrugated material or flexible fabric, or any other similar material or structural design that hides the space between upper and lower shrouds 186, 184 when basin 132 is in a raised position.

Figure 24:
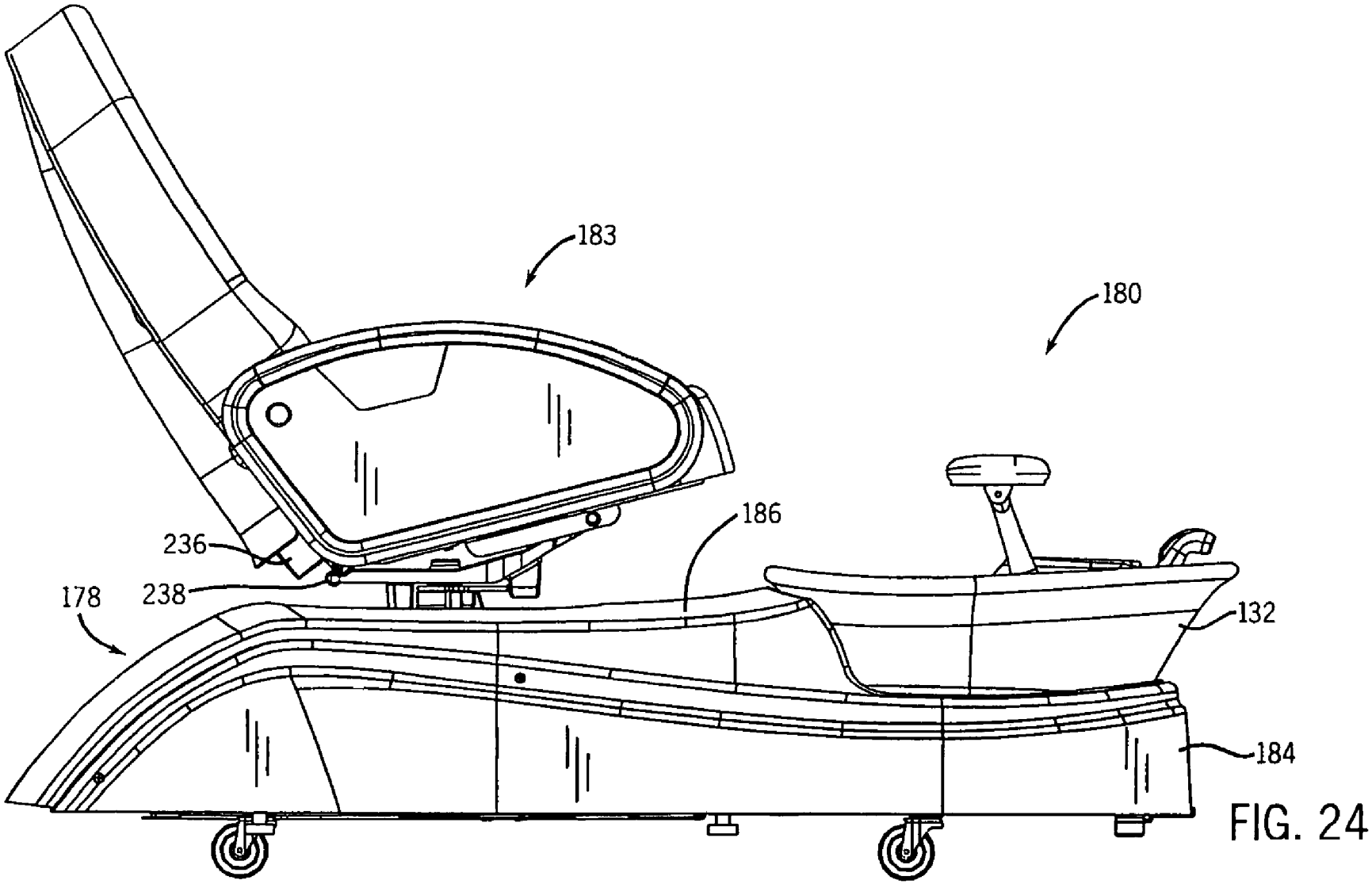
FIG. 24 is a side view of the spa assembly in a lowered position with a chair in a tilt back position.
Figure 25:
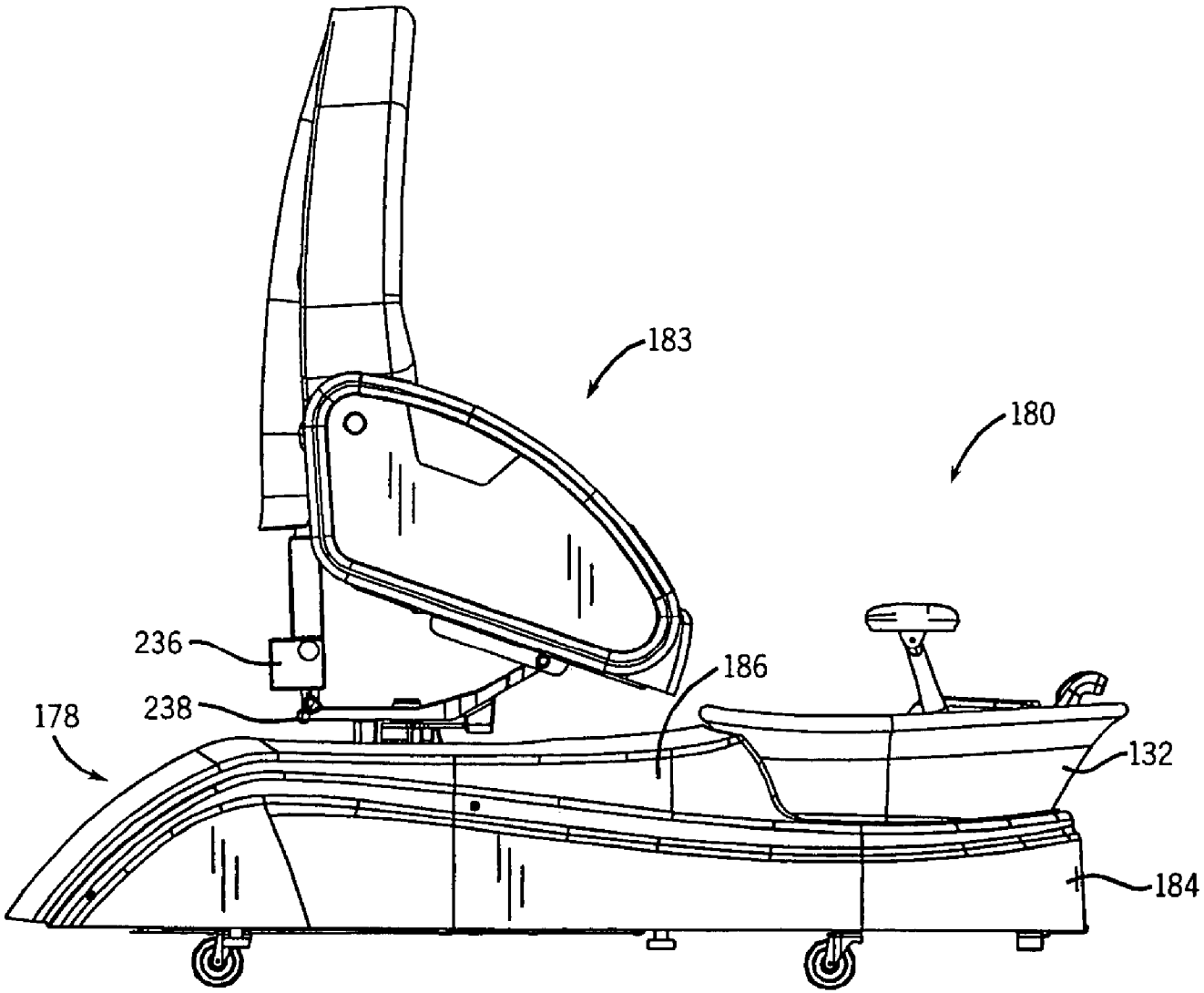
FIG. 25 is a side view of the spa assembly in a lowered position with the chair is a tilt forward position.

Chair 183 is secured to cross member 220. Cross member 220 moves within a pair of rails 232 and is powered in a fore/aft direction by a motor 234. In a preferred embodiment chair 183 is able to move from a position proximate the rear 196 of frame 182 toward front end of frame 182. In one embodiment the chair 183 moves twelve inches from a rear most position to a fore most position. Of course other lengths of travel are also contemplated. Chair 183 also includes a pivot actuator 236 that allows chair 183 to be tilted both in a forwardly and rearwardly direction about pivot 238. A neutral position is illustrated in FIG. 20 and a rearwardly and forwardly tilted position are illustrated in FIGS. 24 and 25 respectively. The specific position of chair 183 in the neutral, rearwardly, and forwardly tilted positions may vary and are not limited to the specific angles shown in the figures. The forward and rearward tilting of chair 183 provides a number of advantages to the user and technician. The rearward tilt of chair 183 provides additional comfort to the user such that they will be in a more reclined position while the technician is working on the user's feet. Additionally, when the user's foot is raised and placed upon cushioned support 166 the user may be more comfortable in a rearwardly tilted position. Additionally, depending on the size of the user it may be comfortable to have the chair 183 in a forwardly tilted position to allow the user to more comfortably place the user's feet within basin 132 to allow for optimal position of the user's feet proximate the openings in foot plate 130 to promote comfort for the user. Additionally, chair 183 is able to swivel about its axis between a neutral position illustrated in FIG. 20 to a side position. Chair 183 may be titled forward when chair 183 is swivel to a safe position to allow a person to more easily enter and exit chair. This feature is particularly useful for elderly or frail users. In a preferred embodiment chair 183 is able to be tilted forward from a neutral position in which the seat cushion 228 is substantially horizontal. In one embodiment the chair 183 is tilted forward at least ten degrees. However, the chair 183 may be tilted more or less. Additionally, in a preferred embodiment seat 183 may be tilted backward twenty degrees as measured from a neutral position in which seat cushion 228 is in a horizontal position. When the upper support 192 is pivoted seven degrees relative to the lower support 190 the total tilt of chair 183 maybe up to twenty seven degrees. Of course by use of different types of actuators, it is possible to increase or decrease the tilt available for chair 183. In a preferred embodiment chair 183 also includes an integrated massage unit located in the upright portion approximate back cushion 230. All of the actuators for tilting chair 183 for fore/aft movement of chair 183 maybe located in a control panel on central console 134 and/or in a separate hand held control unit; or in a control until attached to a portion of chair 183.

Figure 26:
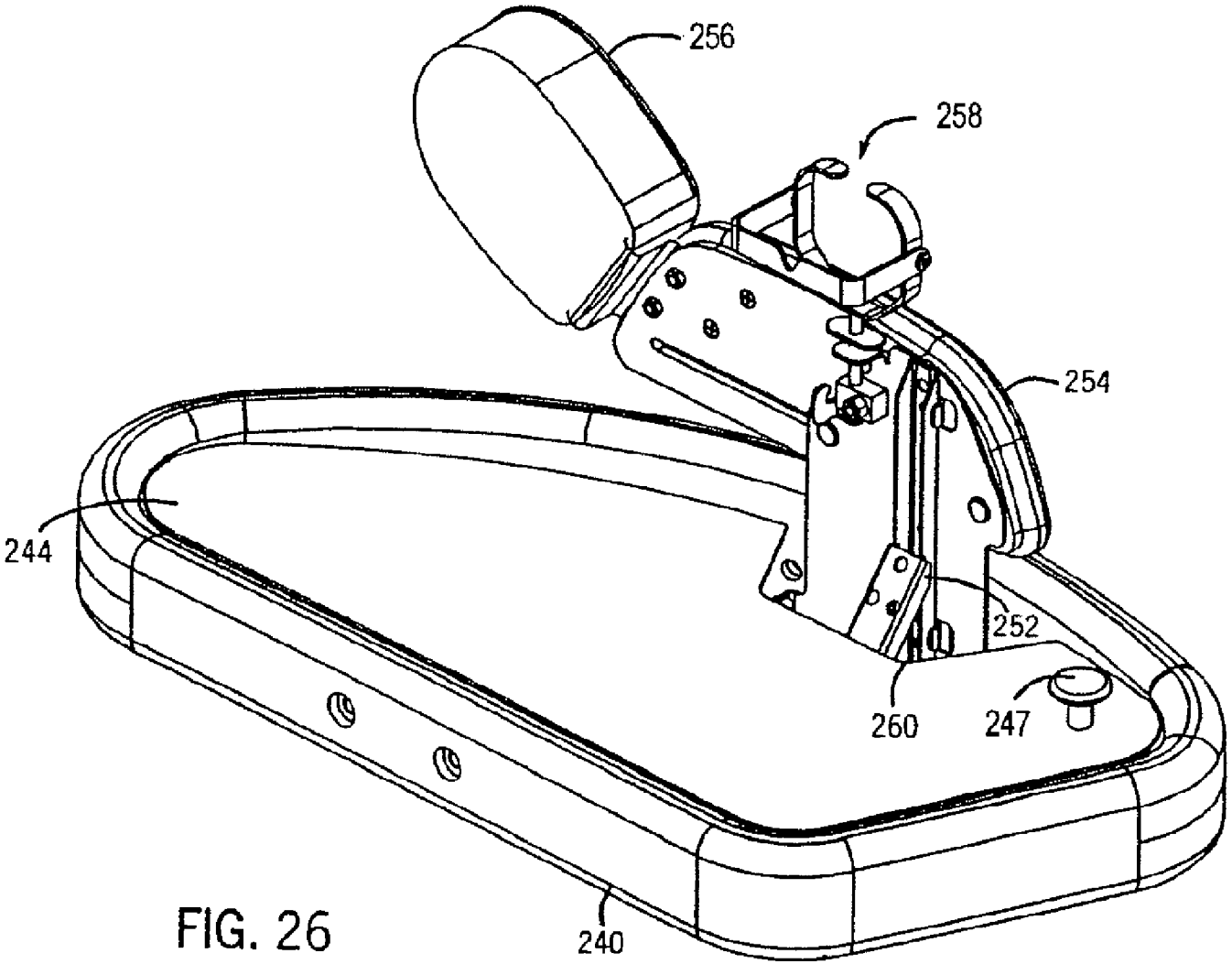
FIG. 26 is a bottom perspective view of the manicure assembly.
Figure 27:
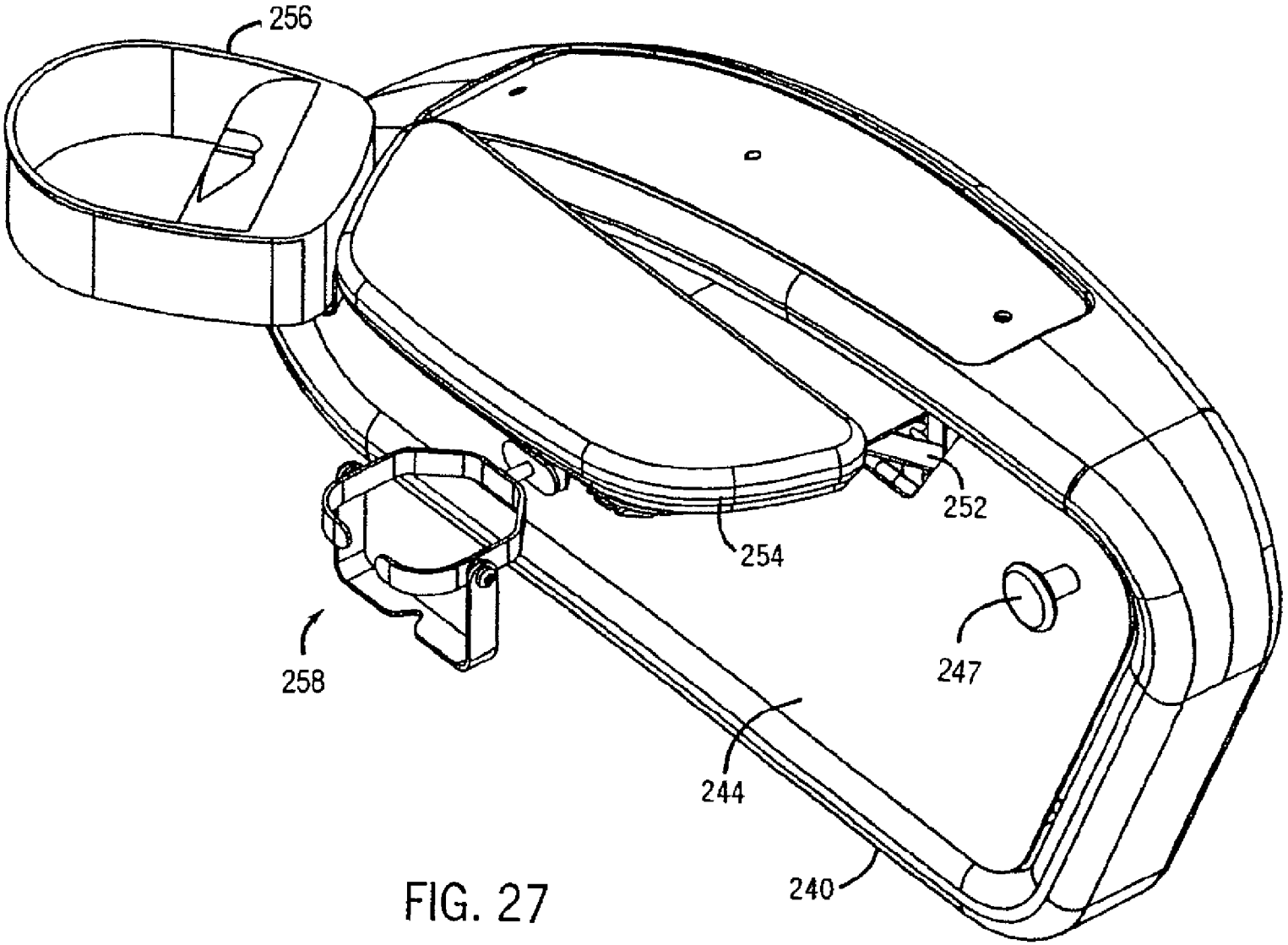
FIG. 27 is a top perspective view of the manicure assembly.
Figure 28:
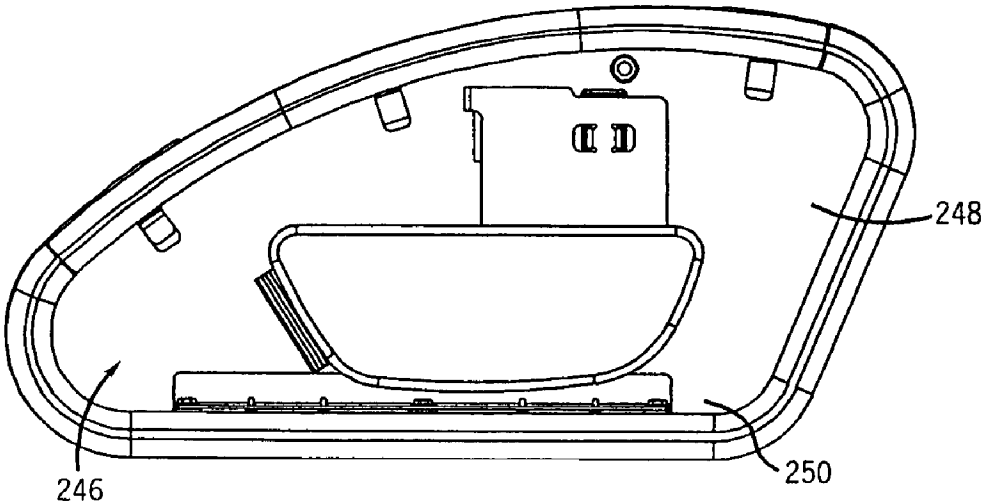
FIG. 28 is a side view of the manicure assembly in a stored position.
Figure 29:
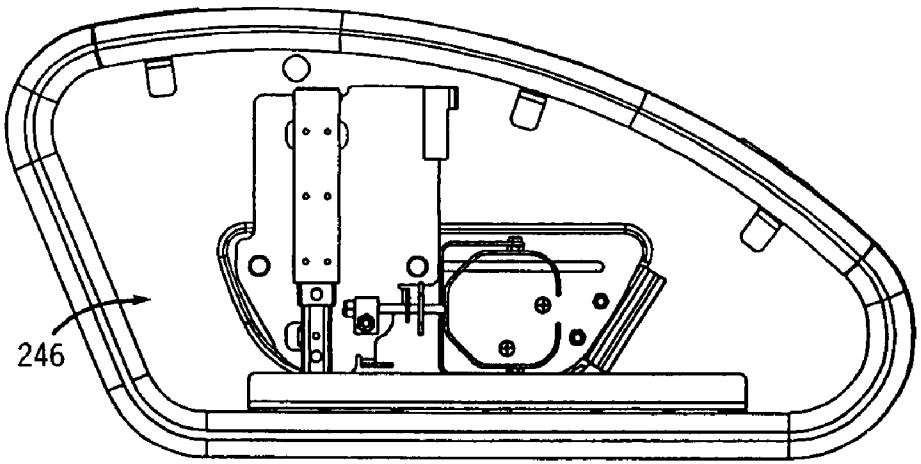
FIG. 29 is a rear side view of the manicure assembly in the stored position.
Figure 30:
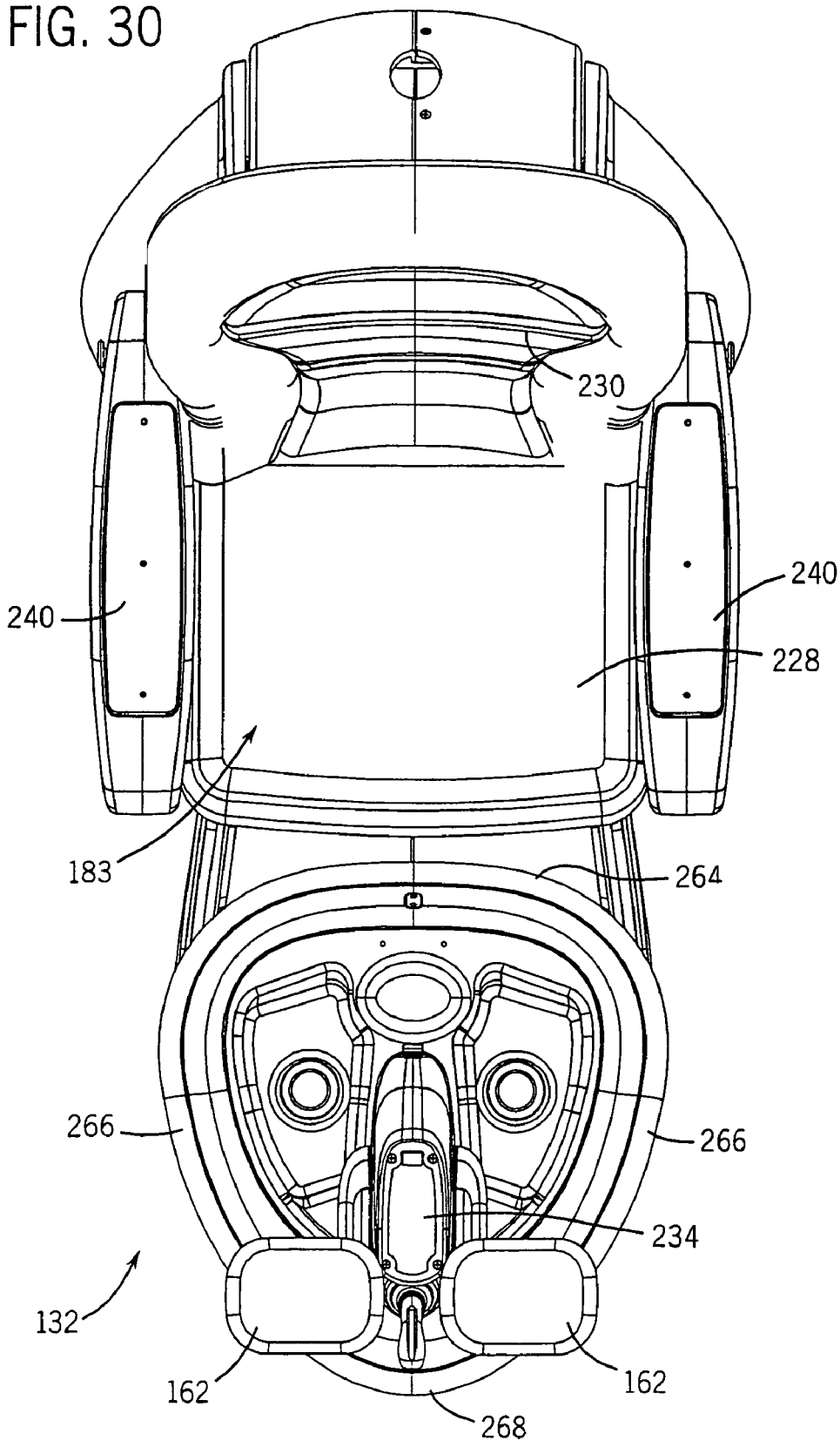
FIG. 30 is a top plan view of the spa assembly.

Referring to FIGS. 26-29, chair 183 includes a right and left arm portion 240. Each arm portion 240, includes a door 244 pivotally attached to a bottom of arm 240. An interior space or cavity 246 is defined between an inner arm surface or wall 248 and door 244. Stored within cavity 246 is a flip-up manicure tray system 250. Referring to FIG. 26, manicure tray system 250 includes an extension arm 252 pivotally attached to the inner arm surface 248 of arm 240 that extends from a position adjacent inner arm surface 248 to an extended operating position substantially perpendicular to inner arm surface 248. Extending from extension arm 252 is an arm rest tray 254 that is slidably moveable relative to extension arm 252. Extending from one end of arm rest tray 254 is a manicure bowl 256 that may be pivotal and foldable upon arm rest tray 254 for easy storage within cavity 246. Manicure tray system 250 further includes a cup holder 258 which is pivotally secured to arm 252 to allow a user to movably place a cup or beverage container within cup holder 258. Door 244 includes a handle 247 and an opening 260 that allows door 244 to be closed while pedicure tray system 250 is deployed. Opening 260 allows extension arm 252 to extend therethrough when door 244 is in the closed position. Door 244 may be closed with the use of magnets with one magnet being located on the inner surface of door 244 and the other magnet being located within cavity 246 of arm 240. Of course, other fasteners for door closures may also be used.

Figure 12:
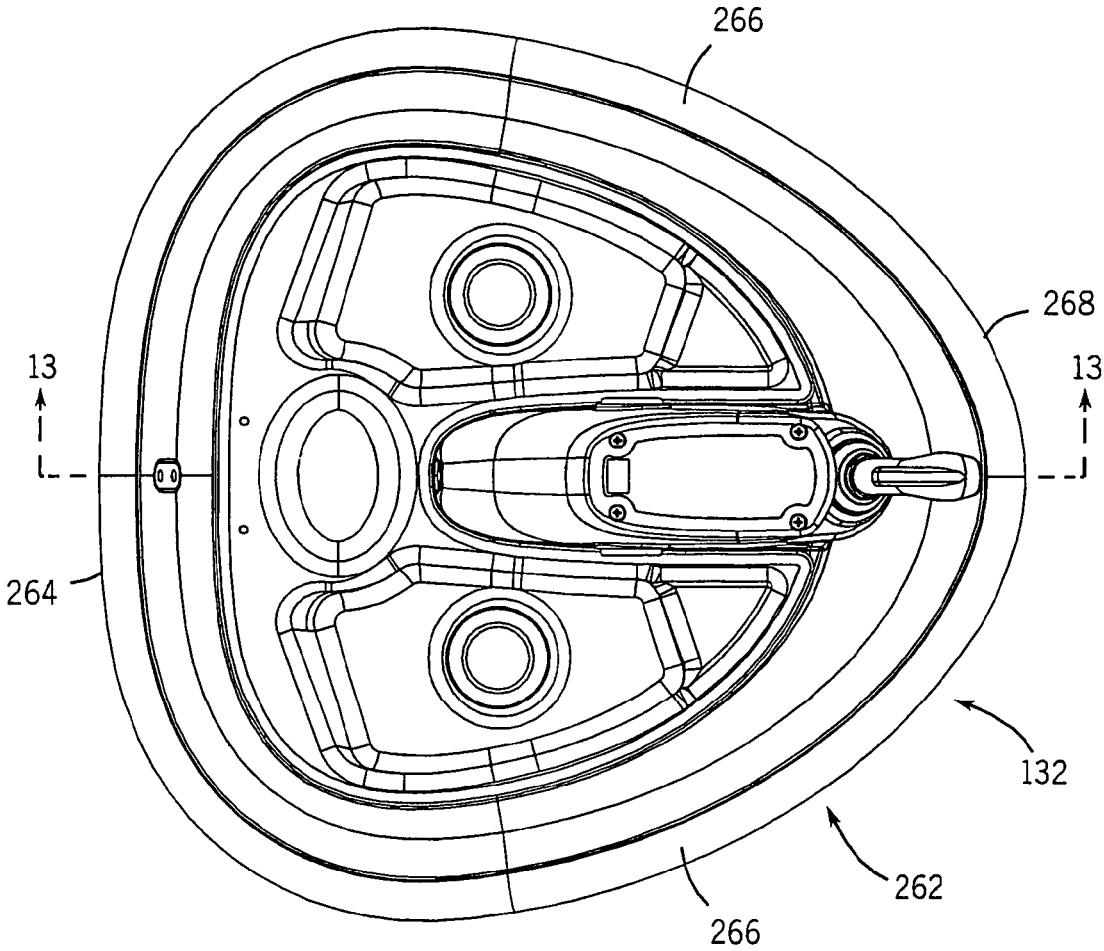
FIG. 12 is a top plan view of the foot rest plate and basin of FIG. 11.
Figure 13:
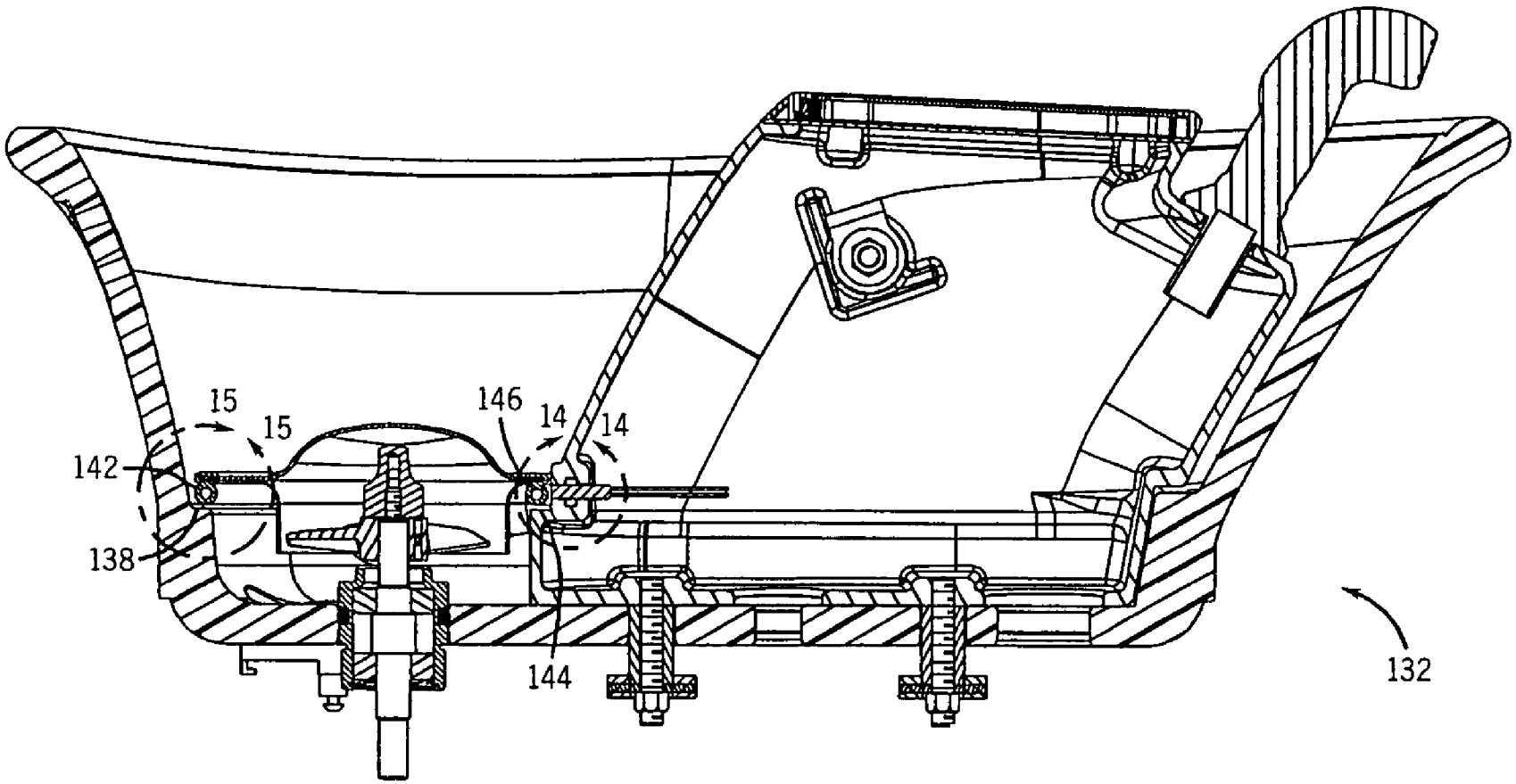
FIG. 13 is a sectional view of the foot rest plate and basin taken generally along lines 13-13 of FIG. 12.
Figure 14:
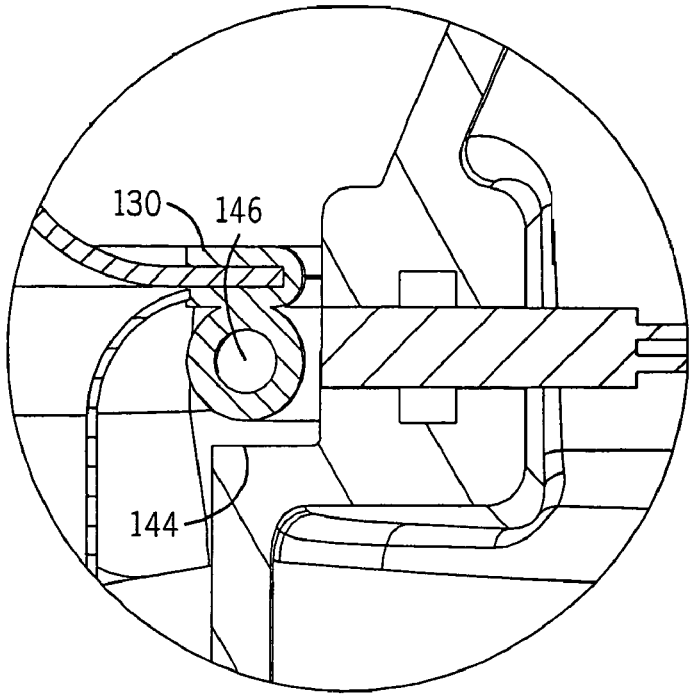
FIG. 14 is a partial view of the foot plate and console taken generally about lines 14-14 of FIG. 13.
Figure 15:
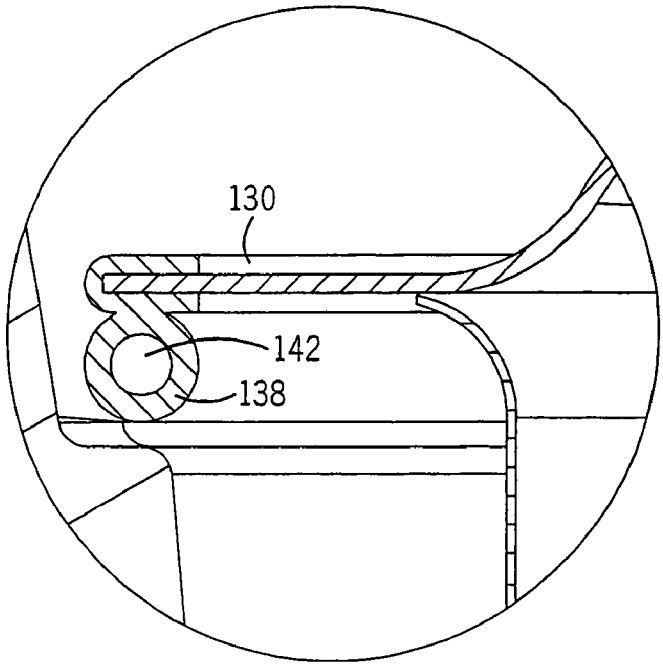
FIG. 15 is a partial view of the foot plate and basin taken generally about lines 15-15 of FIG. 13.
Figure 16:
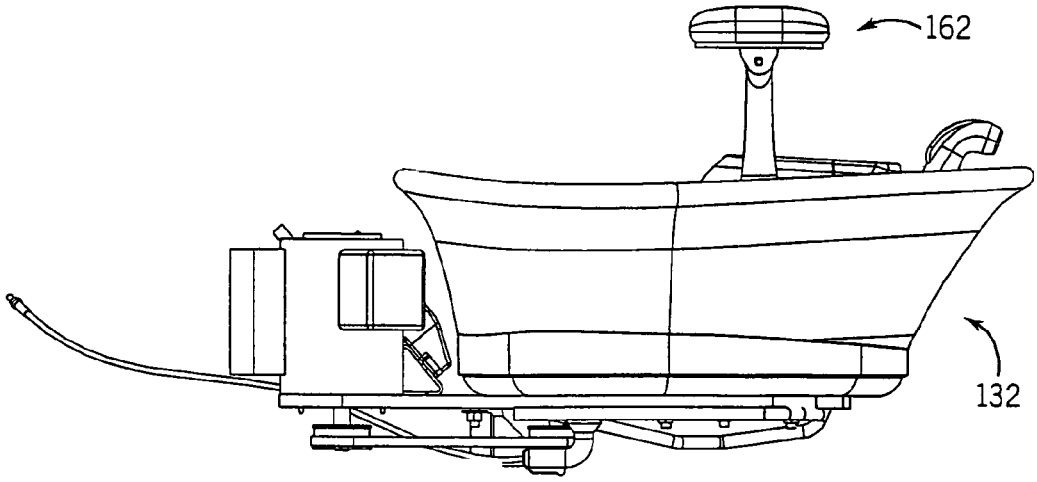
FIG. 16 is a view of a basin and foot rest.

Referring to FIG. 12, the outer profile 262 of basin 132 includes a rear portion 264, two side portions 266, and a front portion 268. Front portion 268 is located proximate the front end of base 178. Referring to FIG. 20, front portion 268 extends outwardly beyond front end of base 178. In one embodiment the end of front portion 268 extends a couple of inches further then the front end of the base. Side portions 266 converge inwardly toward one another proximate front portion 268 such that front portion 268 has a width less than the width of rear portion 264. Additionally, the width of outer profile 262 proximate front portion 268 is less than the width of the rear portion of the outer profile. The width as used herein is the measurement in the cross spa direction that is perpendicular to a longitudinal axis extending the length of spa extending from the rear to the front of the spa. The taper of the profile of basin 132 allows the technician to move close to the front portion of the basin such that the front portion of the basin is between the technicians legs. In contrast, if the basin does not taper toward the front, the technician must sit with their legs both to one side of the basin or extending side ways to the longitudinal axis of the basin. The shape of basin 120 may include a "V" shape front portion having a front most portion with the sides tapering away from the apex. The shape of basin 120 may also be egg shaped having a rounded or relatively flat rear portion, a pair of arcuate sides extending from the rear portion and tapering inward to a front portion. It is advantageous to have the shape of the basin having sufficient taper near the front to allow a technician to place the basin between the technician's knees or legs. In one embodiment the width of the basin is approximately fifteen inches at six inches from the front end of the basin. Of course other tapers may be employed to provide other widths at that point.

It is also important to note that the construction and arrangement of the elements of the spa apparatus as shown in the preferred and other exemplary embodiments are illustrative only. Although only a few embodiments of the present invention have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. For example, the basin of the spa apparatus may be made from borosilicate or other suitable material. Further, other components of the spa apparatus may be manufactured from thermoplastic resins such as injection molded high density polyethylene, polypropylene, other polyethylenes, acrylonitrile butadiene styrene ("ABS"), polyurethane, nylon, any of a variety of homopolymer plastics, copolymer plastics, plastics with special additives, filled plastics, steel, aluminum, alloys, etc. Also, other fabricating, stamping, or molding operations may be used to form these components. Accordingly, all such modifications are intended to be included within the scope of the present invention as defined in this application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the present invention.

What is claimed is:

1. A spa apparatus comprising:

a base having a front end and a rear end;

a basin for retaining fluid supported on the base proximate the front end, the basin including a drain;

a motor operatively connected to the basin for raising and lowering the basin relative to a portion of the base; and a chair supported on the base, intermediate the basin and the rear end of the base, wherein the base includes a lower frame and an upper frame pivotally attached to the lower frame; the basin being supported on the upper frame; an actuator is attached to the lower and upper frames and being movable from a retracted first position to an extended position wherein a front end of the upper frame is moved a vertical distance away from the lower frame.

2. The spa apparatus of claim 1, wherein the base includes a lower shroud covering the lower frame and an upper shroud covering the upper frame.

3. The spa apparatus of claim 2, wherein the upper shroud and lower shroud are telescoping components such that a lower edge of the upper shroud is at the same height or lower than an upper edge of the lower shroud when the upper frame is in a raised position.

4. The spa apparatus of claim 3, wherein the basin is a separate component attached to the base.

5. The spa apparatus of claim 4, further including at least one leg support extending from within an interior of the basin and extending above an upper edge of the basin to support a customer's leg.

6. The spa apparatus of claim 5, wherein the basin includes an impeller located below a foot plate in the basin.

7. The spa apparatus of claim 6, wherein the chair includes an arm having a cavity therein, a manicure apparatus being removably stored within the cavity.

8. The spa apparatus of claim 7, wherein the manicure apparatus includes an arm support and a cup being located at a distal end of the arm support.

9. The spa apparatus of claim 8, wherein the chair includes a seat cushion portion having a front edge and a rear edge proximate a back seat, the chair being tiltable from a first position to a second position, the front edge of the chair cushion being lower in the second position than in the first position and the front edge being lower than the rear edge in the second position.

10. The spa apparatus of claim 9, wherein the chair swivels from a first location substantially in line with the basin to a second location wherein the chair is facing closer to a side of the base.

11. The spa apparatus of claim 10, wherein the foot plate further includes a toe region and a heel region, the heel region being lower than the toe region.

12. A spa apparatus comprising:

a base having a front, an opposing rear and a side extending between the front and rear;

a basin for retaining fluid secured directly to the base;

a drain defined in the basin and configured to release fluid; and a chair being supported by the base and configured to swivel about its axis from a neutral position wherein the chair is substantially in line with the basin to a second location wherein the chair is facing closer to the side of the base, the chair having an actuator secured to a first portion of the chair and the base, the actuator being movable from a first position to a second position wherein the chair is tilted from a first position to a forward tilted position, to aid a person in exiting and/or entering the chair, wherein the chair can swivel independent of the basin and base, wherein the chair includes a seat having a front region and a rear region, the front region being intermediate the rear region and the basin, the front region being lower than the rear region when the seat is in the forward tilted position.

13. A spa apparatus, comprising:

a base;

a basin for retaining fluid;

a drain defined in the basin and configured to release fluid; and a chair being supported by the base, the chair having an actuator secured to a first portion of the chair and the base, the actuator being movable from a first position to a second position wherein the chair is tilted from a first position to a forward tilted position, to aid a person in exiting and/or entering the chair, wherein the chair includes a seat cushion having a front edge and a rear edge, the front edge being lower than the rear edge in the forward tilted position, wherein the chair includes a frame having a lower portion secured to the base and an upper portion pivotally secured to the lower portion, the actuator moving the upper portion and basin relative to the lower portion about a pivot.

14. The spa apparatus of claim 13, wherein the lower portion of the chair frame is supported on a track mechanism providing selected movement along a longitudinal axis extending between a front and a rear of the base.

15. The spa apparatus of claim 14, further providing a second actuator secured to the chair to provide fore/aft movement along the longitudinal axis to move the chair closer to and/or further away from the basin.

16. A spa apparatus comprising;

a base;

a chair supported by the base;

a basin for retaining fluid being supported by the base, the basin including an outer wall defining an interior portion, the outer wall having an upper edge; and at least one foot rest being operatively secured to the basin within the interior portion of the basin, the foot rest having a foot support being above the upper edge of the outer wall in an in-use position, wherein the foot rest includes an arm pivotally secured to a console in the basin, the arm being movable from a first in-use position to a second different stored position.

17. The spa apparatus of claim 16, wherein the arm is frictionally secured to the console with sufficient force to allow the arm to remain in any position between the in-use position and the stored position.

18. The spa apparatus of claim 17, wherein the foot rest includes a cushioned support pivotally attached to a free end of the arm; the cushioned support being located closer to the front end of the basin when the foot rest is in the rest position than when the foot rest is in the in-use position.

19. A spa apparatus, comprising:

a base;

a basin having an upper edge and a front portion opposite a rear portion, the basin being secured to the base;

a chair exterior to the basin and proximate to the rear portion of the basin; and at least one foot support having a first end pivotally coupled proximate to the front portion of the basin and a second free end, the at least one foot support being pivotally movable from a first position wherein the second free end is a first distance from the upper edge of the basin to a second position wherein the second free end is a second distance from the upper edge of the basin, the second distance being greater than the first distance.

20. The spa apparatus of claim 19, wherein the foot support is extendible and retractable independent of a second foot support.

21. A spa apparatus, comprising:

a base configured to sit on the ground;

a basin having a front portion and an opposing rear portion, the basin being disposed on the base;

a footrest having a first portion pivotally coupled proximate to the front portion of the basin and configured to support a first foot and a second portion pivotally coupled proximate to the front portion of the basin and configured to support a second foot, the first portion and the second portion being movable with respect to one another between a first lowered position and a second raised position; and a chair disposed proximate to the rear portion of the basin.

* * * * *

UNITED STATES PATENT AND TRADEMARK OFFICE

CERTIFICATE OF CORRECTION

PATENT NO. : 7,600,273 B2
APPLICATION NO. : 10/744241
DATED : October 13, 2009
INVENTOR(S) : Gruenwald et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1008 days.

Signed and Sealed this

Fourteenth Day of December, 2010

David J. Kappos

David J. Kappos
*Director of the United States Patent and Trademark Office*